US009757847B2

(12) United States Patent
Moreau et al.

(10) Patent No.: US 9,757,847 B2
(45) Date of Patent: Sep. 12, 2017

(54) RATCHET WRENCH WITH A LOCKING RELEASE ASSEMBLY

(71) Applicant: Ty-Flot, Inc., Manchester, NH (US)

(72) Inventors: Darrell A. Moreau, Manchester, NH (US); Andre W. Moreau, Bedford, NH (US); Reginald J. Moreau, Litchfield, NH (US); Ben Bachman, Scranton, PA (US)

(73) Assignee: Ty-Flot, Inc., Manchester, NH (US)

( * ) Notice: Subject to any disclaimer, the term of this patent is extended or adjusted under 35 U.S.C. 154(b) by 328 days.

(21) Appl. No.: 14/695,383

(22) Filed: Apr. 24, 2015

(65) Prior Publication Data

US 2016/0311090 A1 Oct. 27, 2016

(51) Int. Cl.
*B25B 23/00* (2006.01)
*B25B 13/46* (2006.01)

(52) U.S. Cl.
CPC ..... *B25B 23/0035* (2013.01); *B25B 13/461* (2013.01); *B25B 23/0021* (2013.01)

(58) Field of Classification Search
CPC ... B25B 13/461; B25B 23/0035; B25B 13/28; B25B 23/16; B25B 23/0021; B25B 23/18; B25B 13/06; B25B 13/462
See application file for complete search history.

(56) References Cited

U.S. PATENT DOCUMENTS

| | | | |
|---|---|---|---|
| 3,532,013 | A | 10/1970 | Haznar |
| 3,762,245 | A | 10/1973 | Smyers et al. |
| 4,187,747 | A | 2/1980 | Pawlow |
| 4,245,528 | A | 1/1981 | Hugh et al. |
| 4,259,883 | A | 4/1981 | Carlson |
| 4,292,863 | A | 10/1981 | Hickman |
| 4,399,722 | A | 8/1983 | Sardo, Jr. |
| 4,420,995 | A | 12/1983 | Roberts |
| 4,480,511 | A | 11/1984 | Nickipuck |
| 4,508,005 | A | 4/1985 | Herman et al. |

(Continued)

FOREIGN PATENT DOCUMENTS

| | | |
|---|---|---|
| EP | 0165237 B1 | 9/1991 |
| EP | 1107851 B1 | 6/2009 |
| JP | 11-010551 A | 1/1999 |

OTHER PUBLICATIONS

PCT International Search Report and Written Opinion for PCT/US2016/027826, mailing date Jul. 27, 2016.

*Primary Examiner* — Robert Scruggs
(74) *Attorney, Agent, or Firm* — Robert R. Deleault, Esq.; Mesmer & Deleault, PLLC

(57) ABSTRACT

A socket release assembly for a ratchet drive or ratchet wrench that includes a ratchet gear housing, a ratchet head connected to the ratchet gear housing, a push button disposed within the ratchet gear housing and the ratchet head with a portion extending through an opening in the ratchet gear housing, a channel lock disposed within the ratchet gear housing above the ratchet head, a ball lock disposed within the ratchet head and in mating contact with the push button, a ball bearing disposed within the ratchet head between the ball lock and a ball bearing opening in the ratchet head, a release pin within the ball lock and in mating contact with the channel lock where sliding of the release pin causes the channel lock to be slidably positioned allowing the push button to be depressed into ratchet gear housing.

12 Claims, 14 Drawing Sheets

(56) References Cited

U.S. PATENT DOCUMENTS

| | | | | |
|---|---|---|---|---|
| 4,520,697 | A | 6/1985 | Moetteli | |
| 4,762,032 | A | 8/1988 | Chow | |
| 4,938,107 | A | 7/1990 | Nickipuck | |
| 4,962,682 | A | 10/1990 | Rose et al. | |
| 5,214,986 | A | 6/1993 | Roberts | |
| 5,233,892 | A | 8/1993 | Roberts | |
| 5,333,523 | A | 8/1994 | Palm | |
| 5,386,747 | A * | 2/1995 | Grover | B25B 23/0035 81/177.85 |
| 5,390,571 | A | 2/1995 | Fox, III et al. | |
| 5,433,548 | A | 7/1995 | Roberts et al. | |
| 5,501,125 | A | 3/1996 | Roberts et al. | |
| 5,503,048 | A | 4/1996 | Moon | |
| 6,044,730 | A | 4/2000 | Roberts et al. | |
| 6,109,140 | A * | 8/2000 | Roberts | B25B 13/463 81/177.85 |
| 6,260,448 | B1 | 7/2001 | Chaconas | |
| 6,357,974 | B1 | 3/2002 | Robins | |
| 7,066,055 | B1 * | 6/2006 | Lee | B25B 23/0035 81/177.85 |
| 7,240,590 | B1 | 7/2007 | Lin | |
| 2003/0047890 | A1 | 3/2003 | Iwinski et al. | |
| 2003/0110907 | A1 | 6/2003 | Hu | |
| 2006/0144196 | A1 | 7/2006 | Lee | |
| 2007/0000355 | A1 | 1/2007 | Davidson | |
| 2007/0084311 | A1 | 4/2007 | Albertson et al. | |
| 2009/0133538 | A1 | 5/2009 | Tsai | |
| 2009/0324326 | A1 | 12/2009 | Lin | |
| 2010/0132517 | A1 * | 6/2010 | Crawford | B25B 23/0035 81/63 |

* cited by examiner

Fig. 7
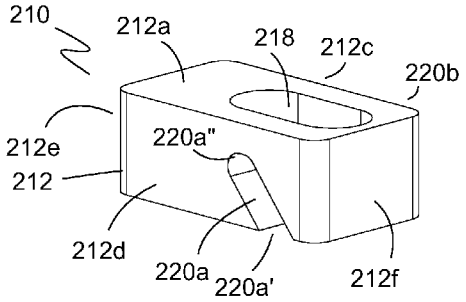
Fig. 7A
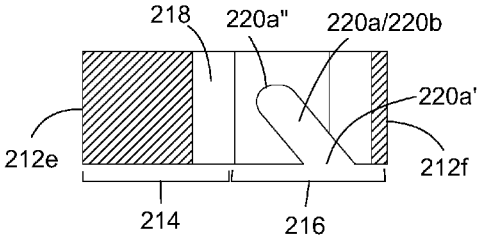
Fig. 7B
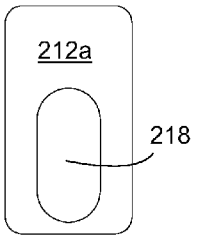
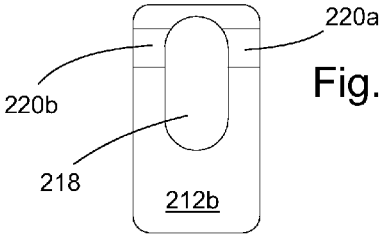
Fig. 7C
Fig. 8
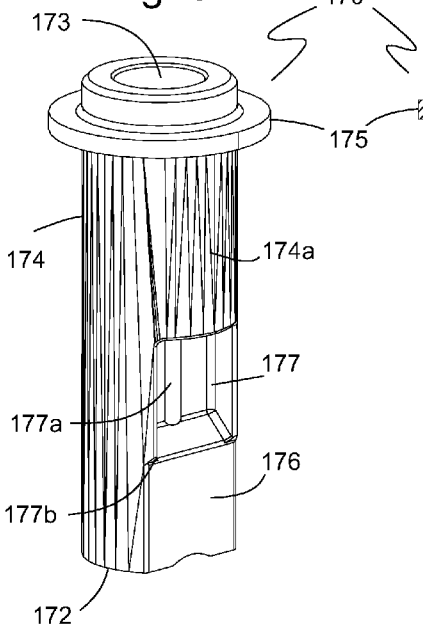
Fig. 8A
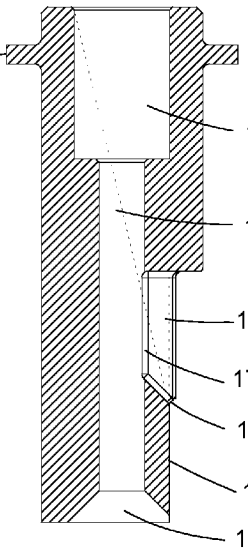
Fig. 8B
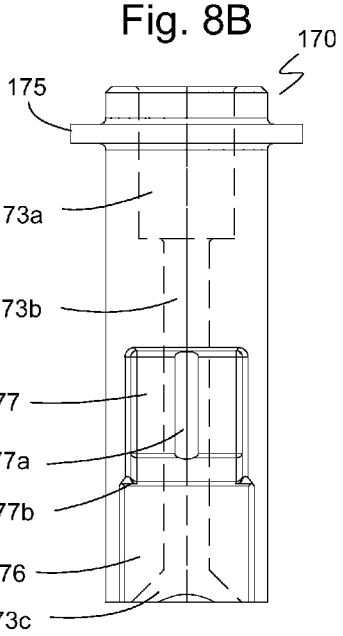

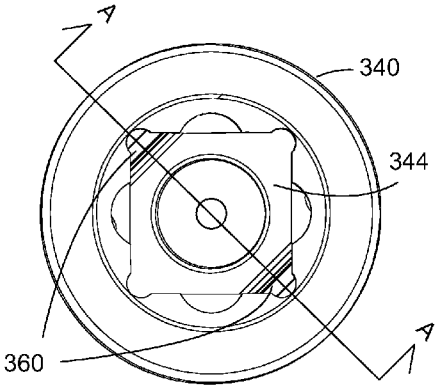
Fig. 15
Fig. 15A
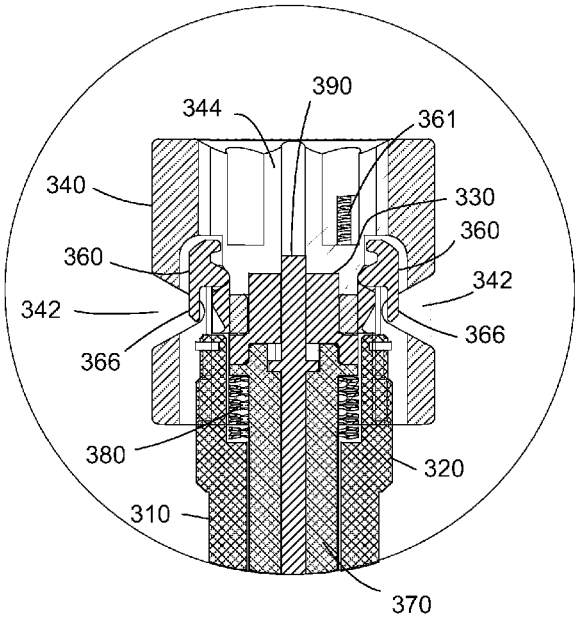
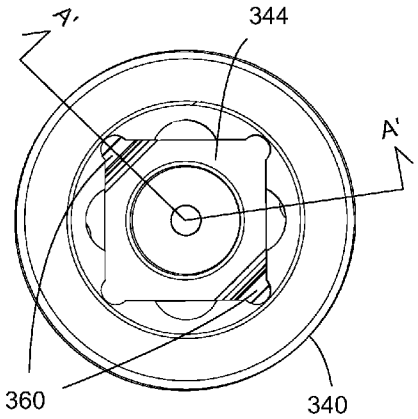
Fig. 16
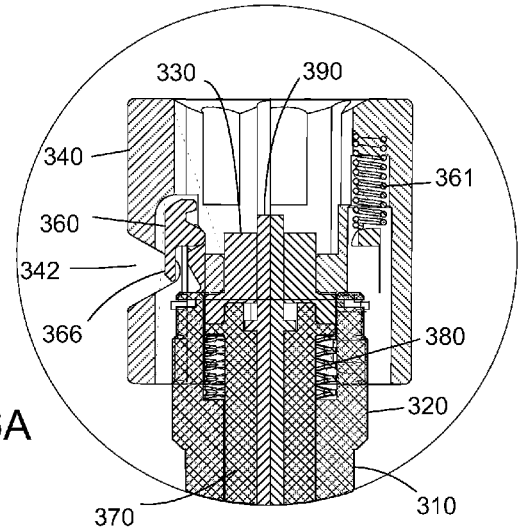
Fig. 16A

Fig. 19
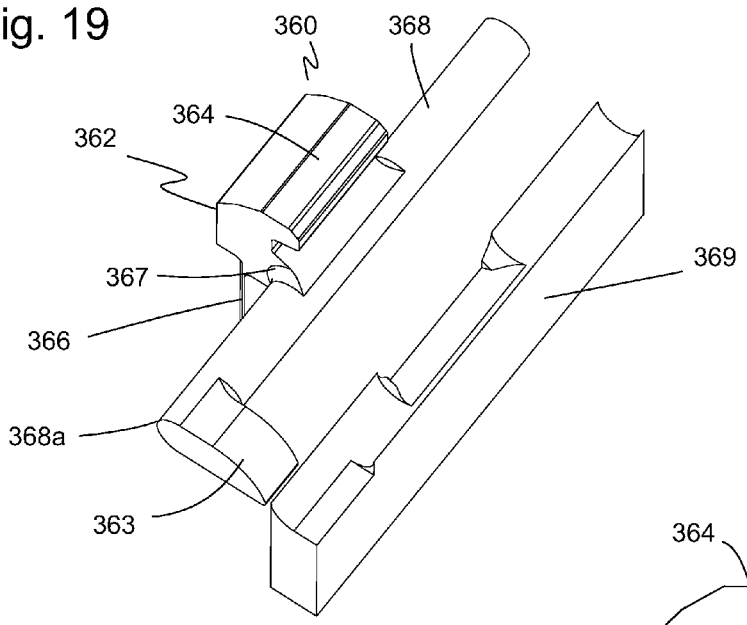
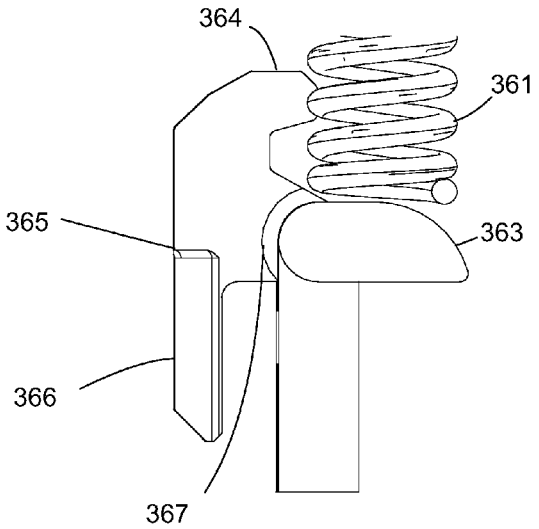
Fig. 21
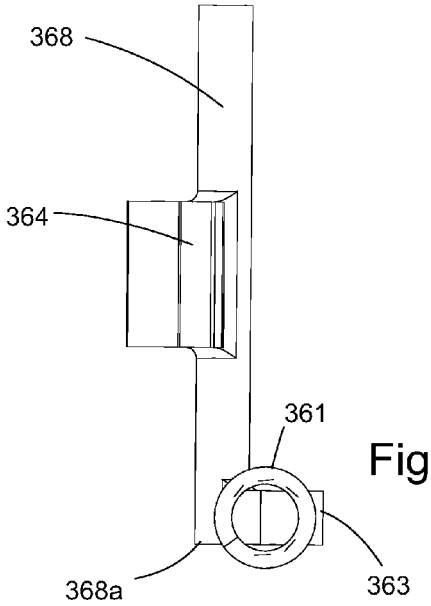
Fig. 20

Fig. 22
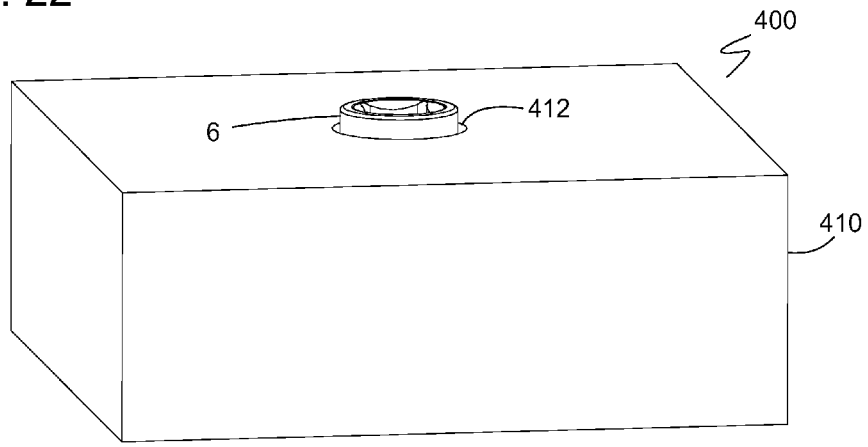
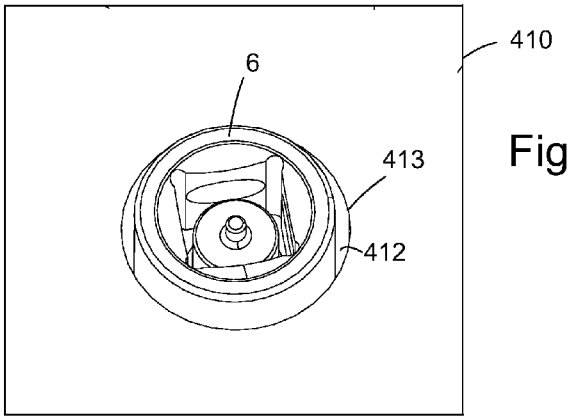
Fig. 23
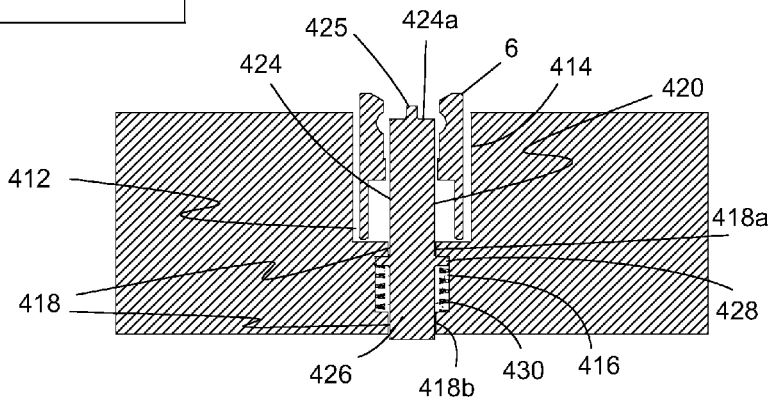
Fig. 24

RATCHET WRENCH WITH A LOCKING RELEASE ASSEMBLY

BACKGROUND OF THE INVENTION

1. Field of the Invention

The present invention relates generally to a ratchet wrench. Particularly, the present invention relates to a ratchet wrench with a quick-release socket system.

2. Description of the Prior Art

Persons engaged in repair and construction type work ordinarily have to use a variety of hand tools to perform tasks. The work commonly takes place over machinery and/or on platforms at various heights above the ground.

Another, more serious concern with the use of hand tools (i.e. hammers, screw drivers, pliers, ratchets, levels, flashlights, tape measures, etc.) occurs when working in overhead situations. If dropped, the hand tool could injure personnel and/or damage equipment located beneath where the work is being performed. A dropped tool exposes persons located below to potential injury or even death if struck by the falling tool. A dropped tool also has the potential to cause damage to machinery located below. The damage can result in many ways. For instance, the damage can be due to the impact of the falling tool on the machinery or parts. Where machinery is operating at the time, the falling tool may come to rest in the path of moving components causing damage to the components and/or necessitating that the machinery be shut down.

However, it is not just the hand tool that could injure personnel and/or damage equipment located beneath where the work is being performed. Component parts of a hand tool such as a socket and/or an extension of a ratchet wrench may become a falling hazard.

The ratchet wrench has several advantages over the conventional closed or open end wrench. The fastener to be tightened or loosened is commonly in a confined location where a wrench has only a limited arc of motion when placed on the fastener. With an open end or a closed end wrench, the wrench must be removed from the fastener each time the limit of the arc of motion is reached and then repositioned. The ratchet wrench can be retained on the fastener with the ratcheting mechanism permitting the wrench to be readily returned to the initial point of motion without the wrench being removed from the fastener. When a reversible ratchet is provided, the wrench can be rotated freely in either direction as needed.

In ratchet wrenches adapted for use with a socket set, it is common to provide a spring loaded detent to secure the socket on the drive member of the wrench during use. In recent years, mechanisms have been developed for quick release of the socket from the wrench by retraction of the detent.

Ratchet wrenches and tools including those of the type which have a socket-locking and quick-release mechanism have been long established in the relevant art. Many and varied types of such mechanisms for ratchet and drive reversing ratchet wrenches have been described in the literature, and mechanisms have been incorporated in commercial ratchet drives sold for use by mechanics. Many of the prior art structures depend upon and invoke substantially the same mechanical principles, each being engineered for use in ratchet drive wrenches in which drive reversal of the wrench is effected by impressing a rotational force on a lever or upon an arcuately-shiftable plate to change the operational orientation of an indexing element. The latter is conveniently a toothed pawl, the teeth of which intercouple or interlock with cooperating teeth formed in a driving collar or ring of the tool head. In such ratcheting devices, counter-rotation of the tool handle effects disengagement of the ratchet teeth to permit the drive handle to be shifted in the opposite direction for subsequent forward reactivation and drive.

Generally, prior mechanisms in the marketplace included a ball-and-spring structure. The socket has a side hole into which the ball snaps as the socket is applied to the mechanism. The socket is removed by simply pulling it off. Alternately, such mechanism has a push-button actuator, which is depressed to remove the socket, thus the name "quick-release" mechanism. Whether or not an actuator is provided, the socket can be removed by forcibly pulling it off. This is disadvantageous because a socket has a tendency to fall off inadvertently during use. The socket could be lost or it could fall into a place where it could cause damage to equipment and/or injury to persons. Particularly when these ratchet wrenches are used in industry, inadvertent dislodgement is highly undesirable.

To preclude the socket from inadvertently falling off during use, certain mechanisms in the marketplace do not permit the socket to be simply pulled off. They have positive locking structure which precludes forcibly pulling the socket off of the ratchet wrench. Instead, a punch or the like must be inserted into the mechanism to release the socket. Other mechanisms are configured to release the locking mechanism upon engagement of the push button of the quick release.

SUMMARY OF THE INVENTION

Although prior art devices have been configured to include certain mechanisms that do not permit the socket to be simply pulled off, the use of other mechanisms configured to release the locking mechanism upon engagement of the push button of the quick release still does not prevent accidental disengagement of a socket from a ratchet wrench caused by engagement of the push button either accidentally or inadvertently. Further, inadvertent activation of the push button will cause release of the socket and/or a ratchet wrench socket extension when used between the ratchet wrench and the socket. Even though the ratchet wrench hand tool may be secured by a lanyard to prevent accidental or inadvertent drops of the hand tool, nothing prevents the socket and/or the socket extension from such an accidental or inadvertent release from the ratchet wrench. An accidental or inadvertent release of the socket and/or socket extension can also cause potential injury or even death to a person below or to cause damage to machinery located below.

It is an object of the present invention to provide a socket release assembly for a ratchet drive or wrench that prevents accidental or inadvertent release of a socket and/or socket extension.

It is another object of the present invention to provide a socket release assembly for a ratchet drive or wrench that is configured to operationally cooperate with a socket extension that also operationally cooperates with a socket to prevent accidental or inadvertent release of either the socket or the extension.

The present invention achieves these and other objectives by providing, in one embodiment, a socket release assembly for a ratchet drive or ratchet wrench that includes a ratchet gear housing, a ratchet head connected to the ratchet gear housing, a push button disposed within the ratchet gear housing and the ratchet head with a portion extending through an opening in the ratchet gear housing, a channel lock disposed within the ratchet gear housing above the ratchet head, a ball lock disposed within the ratchet head and in mating contact with the push button, a ball bearing disposed within the ratchet head between the ball lock and a ball bearing opening in the ratchet head, a release pin within the ball lock and in mating contact with the channel lock where sliding of the release pin causes the channel lock to be slidably positioned allowing the push button to be depressed into the ratchet gear housing. The ratchet gear housing has a gear housing open end, a gear housing closed end having a closed end opening, and a housing internal space between the gear housing open end and the gear housing closed end. The ratchet head having an upper head portion, an upper head open end, a lower head portion having a substantially square-shaped cross-section, a lower head open end, and a head internal space extending between the upper head open end and the lower head open end. The upper head portion is disposed in the gear housing open end and fixedly attached within the housing internal space. The lower head portion has a ball bearing opening adjacent to and spaced from the lower head open end and extending through a side of the lower head portion. The push button has a button body, an upper button body portion, a first button end, a second button end, an internal channel extending longitudinally between the first button end and the second button end, and a button slot extending transversely through the button body adjacent the second button end. The channel lock has a channel lock body, a top lock surface, a bottom lock surface, a first lock side, a second lock side, a channel lock slot extending between the first lock side and the second lock side, and an elongated lock channel extending between the top lock surface, the bottom lock surface, the first lock side, the second lock side, and containing the channel lock slot. The channel lock slot extends angularly from the bottom lock surface a predefined distance towards the top lock surface. The channel lock is slidably disposed within the button slot between a push button locking position and a push button unlocking position. The ball lock has a ball lock body with a push button engaging end, a ball lock bottom end, a lock body flange extending transversely from an outer surface of the ball lock body adjacent to and spaced from the push button engaging end, a body side portion that extends longitudinally from the ball lock bottom end a predefined distance along the ball lock body defining a ball bearing locking notch and a ball bearing releasing notch, and a stepped internal lock body space having a lower stepped portion and an upper stepped portion. The ball lock is slidably disposed within the head internal space. The release pin has an upper pin portion, a lower pin portion, and a release pin flange extending transversely between the upper pin portion and the lower pin portion. The release pin is slidably disposed within the stepped internal lock body space and extends from the ball lock bottom end through the channel lock body and into the upper button portion of the push button. The release pin has a pin dowel extending transversely from the upper pin portion, which is disposed within the channel lock slot of the channel lock to cause the channel lock to slide within the button slot between the push button locking position and the push button unlocking position when the release pin is slidably moved within the ball lock.

In one embodiment of the present invention, the ratchet head has at least one corner recess formed at a corner of the lower head portion adjacent to and spaced from the lower head open end In another embodiment of the present invention, the socket release assembly includes a release pin spring disposed on the release pin that biases the release pin into a button locking position.

In a further embodiment of the present invention, the socket release assembly includes a ball lock release spring disposed on the ball lock that biases the ball lock into an orientation to maintain the ball bearing within the ball bearing locking recess.

In still another embodiment of the present invention, the socket release assembly includes a ball lock having a ball lock bottom end with a frusto-conical recess and where a lower pin end of the lower pin portion of the release pin is disposed in the frusto-conical recess and spaced from the ball lock bottom end.

In yet another embodiment of the present invention, the push button has a ball lock engaging end that is in constant mating contact with a proximal lock body of the ball lock.

In another embodiment of the present invention, the socket release assembly includes a socket extension. The socket extension has an extension receiver with an upper ratchet head opening, a lower receiver opening, a ratchet head recess, and an extension lock disposed within the extension receiver, an extension body having an extension receiver portion with an extension receiver open end, an extension body middle portion, an extension socket portion with an extension socket open end, an extension internal body space extending between the extension receiver open end and the extension socket open end. The extension receiver portion is fixedly secured to the lower receiver opening of the extension receiver. The extension socket portion has a ball bearing opening adjacent to and spaced from the extension socket open end and extends through a side of the extension socket portion. The extension ball bearing opening is in fluid communication with the extension internal body space. The socket extension also includes an extension ball lock having an extension ball lock body with a ball lock adapter engaging end, an extension ball lock bottom end, an extension lock body flange extending transversely from an extension outer body surface of the extension ball lock body adjacent to and spaced from the release pin engaging end, an extension body side portion that extends longitudinally from the extension ball lock bottom end a predefined distance along the extension ball lock body defining an extension ball bearing locking notch and an extension ball bearing releasing notch, and an extension ball lock internal space having a lower space portion and an upper space portion, the extension ball lock being slidably disposed within the extension body and the extension receiver. There is also a socket retaining ball bearing disposed within the extension ball lock internal space between the extension body side portion and the extension socket portion through the ball bearing opening. Specifically, the socket retaining ball bearing is disposed within the extension ball bearing locking notch between the extension body side portion and the lower extension body portion through a side portion of the lower socket extension end, and an extension release pin having an extension pin upper portion, a extension pin lower portion, and an extension release pin flange extending transversely between the extension pin upper portion and the extension pin lower portion, the extension release pin slidably disposed within the extension ball lock internal space and extending from the extension lower space portion and out through the extension ball lock adapter a predefined distance. The extension body has an extension internal body space extending between the extension receiver open end and the extension socket open end. The extension lock in the extension receiver has an elongated lock body and a retaining hook element extending transversely from the elongated lock body where the retaining hook element has a retaining hook. The extension lock is positioned to pivotally position the retaining hook into and out of the ratchet receiver recess where the retaining hook is configured to engage with at least one lower head notch of the lower head portion when the ratchet head is disposed within the extension receiver.

In another embodiment, the socket extension includes an extension ball lock biasing element that is a release spring disposed on the extension ball lock that biases the extension ball lock into an orientation to maintain the extension ball bearing within the extension ball bearing locking recess.

In a further embodiment, the socket extension has an extension ball lock with an extension ball lock bottom end that has a frusto-conical recess. A lower extension pin end of a extension pin lower portion of the extension release pin is disposed in the frusto-conical recess and spaced from the extension ball lock bottom end.

In still another embodiment, the socket extension has an extension release pin with a release pin engaging end of the extension ball lock body that is in constant mating contact with the ball lock bottom end of the ball lock body when the socket extension is connected to the ratchet head of the socket release assembly.

In another embodiment of the present invention, there is included a socket holder having a socket recess with a recess bottom and a recess opening for holding a socket, and a socket holder peg disposed centrally within the socket recess and extending vertically from the recess bottom toward the recess opening. The socket holder peg has a release pin engaging element adapted for alignment with the release pin of the socket release assembly where the pin engaging element engages the release pin to cause the release pin to slidably move within the ball lock body when attaching the ratchet head to a socket wherein the pin dowel disposed within the channel slot of the channel lock causes the channel lock to slide within the button slot to the push button unlocking position.

In yet another embodiment of the present invention, there is described a method of preventing the inadvertent or accidental release of a socket from a ratchet. The method includes engaging a release pin slidably and centrally disposed within a ball lock of a ratchet head by a release pin engaging element disposed in a socket holder, pushing the ratchet head toward the socket holder where the release pin engaging element causes the release pin to remain stationary while the ratchet head moves into a socket disposed and held by the socket holder causing a channel lock to slide transversely relative to the release pin to a push button unlocking position, pushing a push button to slide a ball lock to a ball bearing unlocked position so that the ratchet head enters the socket to a point where a ball bearing in the ratchet head aligns with a ball bearing recess in a wall of the socket, and releasing the push button to thereby slide the ball lock to a ball bearing locked position and lock the ball bearing in the ball bearing recess capturing the socket onto the ratchet head while the release pin simultaneously causes the channel lock to return to a push button locking position preventing unintended release of the socket from the ratchet head.

BRIEF DESCRIPTION OF THE DRAWINGS

FIG. 7 is a perspective view of one embodiment of the channel lock of FIG. 3.

FIG. 7A is a cross-sectional view of the channel lock of FIG. 7 taken along lines A-A.

FIG. 7B is a top plan view of the channel lock of FIG. 7.

FIG. 7C is a bottom plan view of the channel lock of FIG. 7.

FIG. 8 is a perspective view of one embodiment of the ball lock of FIG. 3.

FIG. 8A is a cross-sectional view of the ball lock of FIG. 8 taken along lines A-A.

FIG. 8B is a front plan view of the ball lock of FIG. 8.

FIG. 15 is a top plan view of the extension receiver of FIG. 13 showing a view line A-A.

FIG. 15A is a cross-sectional view of an extension receiver of FIG. 13 taken along line A-A.

FIG. 16 is a top plan view of the extension receiver of FIG. 13 showing a view line A'-A'.

FIG. 16A is a cross-sectional view of an extension receiver of FIG. 13 taken along line B-B.

FIG. 19 is a perspective view of the extension lock of FIG. 17.

FIG. 20 is a top view of the extension lock of FIG. 19.

FIG. 21 is a side view of the extension lock of FIG. 20.

FIG. 22 is a perspective view of one embodiment of a socket holder with socket of the present invention.

FIG. 23 is an enlarged, perspective view of the socket in the socket holder of FIG. 22.

FIG. 24 is a cross-sectional view of the socket holder with socket of FIG. 22.

DETAILED DESCRIPTION

Figure 1:
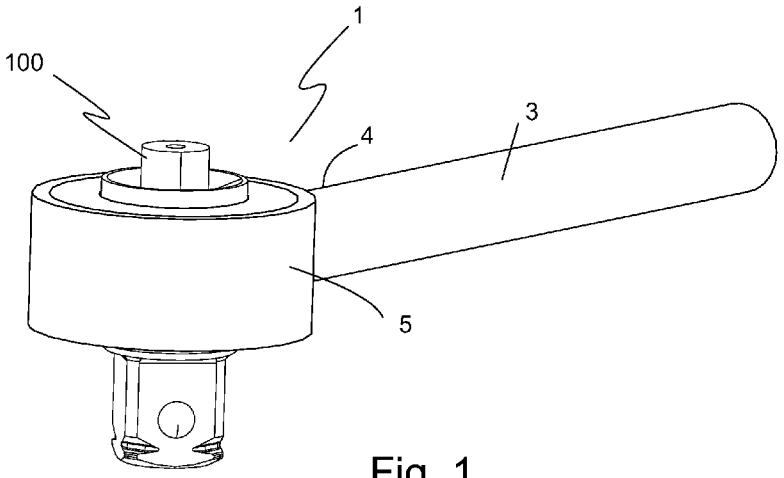
FIG. 1 is a perspective view of one embodiment of the present invention showing a ratchet wrench with a socket release assembly disposed within a head of the ratchet wrench.
Figure 2:
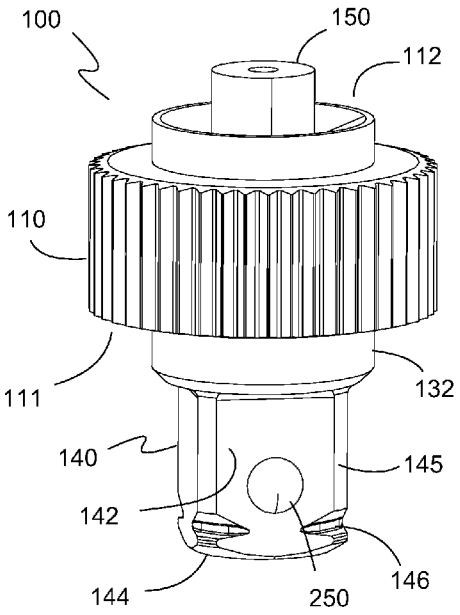
FIG. 2 is a perspective view of one embodiment of the socket release assembly of FIG. 1.

One embodiment of the present invention is illustrated in FIGS. 1-30. FIG. 1 shows one embodiment of the present invention having a ratchet drive or wrench 1 with a handle 3, a ratchet hub 5 connected to a first handle end 4, and a socket release assembly 100 disposed within ratchet hub 5. FIG. 2 illustrates socket release assembly 100 having a ratchet gear housing 110, a ratchet head 130 extending from a bottom end 111 of ratchet gear housing 110 in typical fashion for mating with a socket (not shown), and a push button 150 extending from a top end 112 of ratchet gear housing 110 that is opposite bottom end 111. Ratchet head 130 has an upper head portion 132 and a lower head portion 140 where lower head portion 140 has a square-shaped cross-section having lower head sides 142 and lower head corners 145 with a ball bearing 250 protruding from one of the lower head sides 142 of lower head portion 140. Lower head portion 140 has a distal end 144 and a plurality of lower head notches 146 formed into lower head corners 145.

Figure 3:
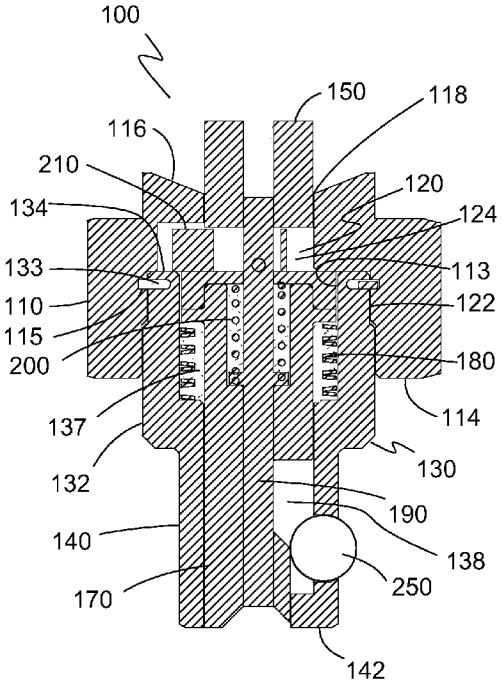
FIG. 3 is a longitudinal, cross-sectional view of the socket release assembly of FIG. 2.

FIG. 3 discloses a cross-sectional view of socket release assembly 100. Socket release assembly 100 includes ratchet gear housing 110, ratchet head 130, slidable push button 150, a ball lock 170 slidably disposed within ratchet head 130, a release pin 190 slidably disposed within ball lock 170, and a channel lock 210 disposed transversely and slidably through push button 150. There is also included two biasing elements such as, for example, springs; a ball lock biasing element 180 and a release pin biasing element 200. Ratchet gear housing 110 has a gear housing open end 114, a gear housing closed end 116 with a closed end opening 118, and a housing internal space 120 between gear housing open end 114 and gear housing closed end 116. Housing internal space 120 has a first internal space 122 extending into ratchet gear housing 110 from gear housing open end 114, and a second internal space 124 that has a smaller volume than first internal space 122 where second internal space 124 extends from closed end opening 118 of gear housing closed end 116 and fluidly communicates with first internal space 122.

Ratchet head 130 includes an internal head space 136 that extends longitudinally completely through ratchet heat 130 from an upper head open end 134 to a lower head open end 142. Internal head space 136 defines an upper head space 137 and a lower head space 138. Upper head space 137 has a larger diameter than lower head space 138 where upper head space 137 is disposed completely within upper head portion 132 while lower head space 138 extends from lower head open end 142 into upper head portion 132 and fluidly communicates with upper head space 137. In effect, upper head space 137 and lower head space 138 define a stepped configuration of internal head space 136.

Slidably disposed within internal head space 136 is ball lock 170 and ball lock biasing element 180. Ball lock biasing element 180 maintains ball lock 170 in an orientation that locks ball bearing 250 in a protruding orientation from one of the lower head sides 142 of lower head portion 140. Ball lock 170 is engaged by push button 150 to change the orientation of ball bearing 250 from a locked position to an unlocked position allowing ball bearing 250 to recede into lower head portion 140 of ratchet head 130.

Release pin 190 is slidably disposed within ball lock 170 and extends longitudinally upwards beyond ball lock 170 through channel lock 210 and within push button 150. Release pin biasing element 200 is disposed within ball lock 170 and provides a biasing force to release pin 190 to maintain channel lock 210 in a locking orientation preventing push button 150 from activating ball lock 170 to release ball bearing 250 from a locked or protruding orientation from lower head portion 140 into an unlocked or receded orientation into lower head portion 140.

Figure 4:
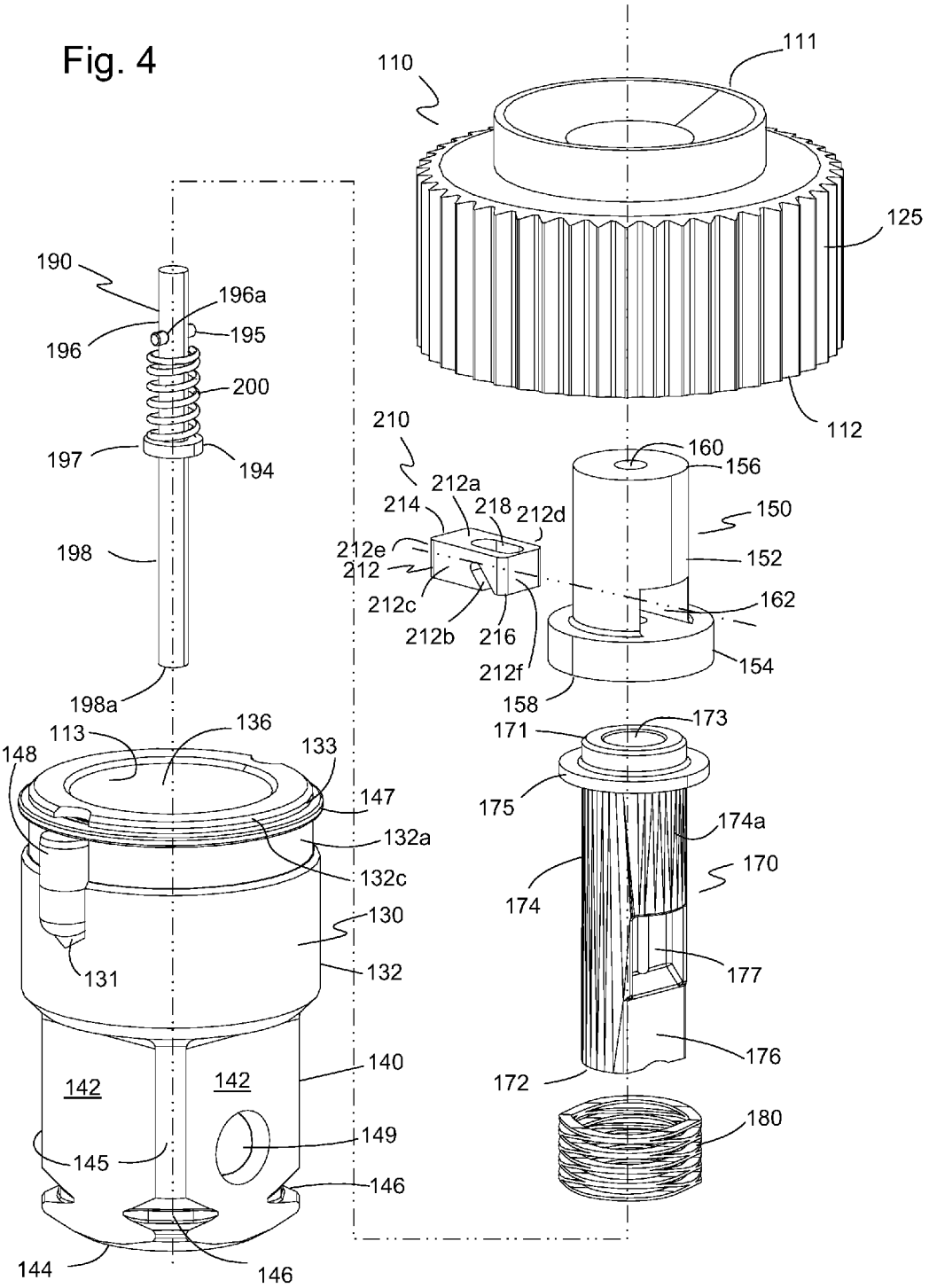
FIG. 4 is an exploded, perspective view of the socket release assembly of FIG. 2 showing various components of the socket release assembly.

Turning now to FIG. 4, there is illustrated an exploded view of socket release assembly 100. Ratchet head 130 further includes a ball bearing opening 149 that has a diameter smaller than ball bearing 250 so that ball bearing 250 protrudes from lower head side 142 but cannot fall outward. Upper head portion 132 has optionally one or more recesses 131 disposed in an outer surface 132*a* of upper head portion 132. Although not shown, ratchet gear housing 110 includes matching recesses within an inner wall 113 of housing 110 (not shown). An anti-rotation element 148 is disposed in the matching recesses of the upper head portion 132 and the ratchet gear housing 110 to prevent the ratchet head 130 from rotating independently from the rotation of ratchet gear housing 110 within ratchet hub 5. To maintain ratchet head 130 locked into ratchet gear housing 110, there is provided an upper head annular groove 133 in outer surface 132*a* adjacent a head proximal end 132*c* into which is secured a head retaining fastener 147 such as split ring, a set screw, a pin, an expansion pin, and the like. If a split ring is used as illustrated, then there is a corresponding gear housing annular groove 115 (illustrated in FIG. 3) disposed within inner wall surface 113 of ratchet gear housing 110. For a pin, then corresponding openings are formed transversely through ratchet gear housing 110 and into upper head portion 132. For a set screw, the opening through ratchet gear housing 110 would necessarily be threaded.

Release pin 190 includes a release pin body 191 having an upper pin portion 196, a lower pin portion 198 with a release pin lower end 198*a*, a pin flange 194 that extends transversely from an outer circumferential surface 192. Pin flange 194 is positioned at a predefined location on a middle portion 197 of release pin body 191. Pin flange 194 may be continuous annular rim or a plurality of annular rim segments or a single protrusion or a through pin where pin flange 94 prevents pin biasing element 200 from moving along release pin body 191 beyond pin flange 94. Upper pin portion 196 has a through opening 196*a* transversely disposed though release pin body 191 into which is secured a pin dowel 195. Pin basing element 200 is disposed onto upper pin portion 196 between pin flange 194 and pin dowel 195. Pin dowel 195 interacts with channel lock 210, which will be explained in more detail later. In the embodiment where a pin dowel 195 is inserted into through opening 196*a*, pin dowel 195 is fixedly attached to upper pin portion 196. It is contemplated that pin dowel 195 and upper pin portion 196 may be a unitary structure made by machining, casting or mold injecting.

Ball lock 170 has a ball lock body 174 with a push button engaging end 171, a ball lock bottom end 172, and a lock body outer circumferential surface 174*a*. Adjacent to and spaced from push button engaging end 171 is a lock body flange 175. Lock body flange 175 may be continuous annular rim or a plurality of annular rim segments or a single protrusion or a through pin where lock body flange 175 prevents lock body biasing element 180 from moving along ball lock body 174 beyond lock body flange 175. Ball lock body 174 has a through opening 173 defining a stepped internal space for accommodating release pin 190 and pin biasing element 200 therein. Beginning at ball lock bottom end 172, there is a body side portion 178 that defines a ball bearing locking notch 176 and a ball bearing releasing notch 177. Ball bearing locking notch 176 formed longitudinally into lock body outer surface 174*a* a predefined distance and having a predefined depth into ball lock body 174. The predefined depth is such that ball bearing 250 when captured in ball recess notch 176 will protrude out of ball bearing opening 149 of lower head portion 140. Ball bearing releasing notch 177 is formed longitudinally into lock body outer surface 174*a* that is adjacent and coterminous with ball bearing locking notch 176. Ball bearing releasing notch 177 extends longitudinally along ball lock body 174 a predefined distance and having a predefined depth into ball lock body 174 that is greater than the depth of ball bearing locking notch 176. The predefine depth of ball bearing releasing notch 177 is such that ball bearing 250 is allowed to recede from ball bearing opening 149 to release a captured socket (not shown). It is the longitudinal movement of ball lock 170 and its position that determines whether ball bearing 250 is in a locked or unlocked orientation relative to a socket. As previously disclosed, ball lock 170 is slidably disposed within ratchet head 130 and release pin 190 is slidably disposed within ball lock 170.

Push button 150 has a button body 151 that includes a first push button portion 152, a second push button portion 154, a first push button end 156, a second push button end 158, and a longitudinal push button through opening 160 extending from proximal button end 158 to distal button end 156. In this embodiment, second push button portion 154 has a longer periphery than first push button portion 152 when viewed from proximal push button end 158. Push button 150 also includes a transversely oriented push button slot 162 that extends completely through first push button portion 152. Lower head open end 156 matingly engages push button engaging end 171 when assembled. Also when assembled, upper pin portion 196 extends through second push button portion 154 and into first push button portion 152 such that pin dowel 195 is always disposed within push button slot 162.

Channel lock 210 has a channel lock body 212 with a first cross-sectional shape that is substantially similar to a first cross-sectional shape of push button slot 162. Channel lock body 212 has a first lock body portion 214 and a second lock body portion 216 where second lock body portion 216 is slidably maintained within push button slot 162 while first lock body portion 214 is slidably maintained outside of push button slot 162. Channel lock body 212 has a channel lock top surface 212*a*, a channel lock bottom surface 212*b*, a first channel lock side 212*c*, a second channel lock side 212*d*, a first end 212*e* and a second end 212*f*. An elongated lock body through slot 218 extends between channel lock top surface 212*a* to channel lock bottom surface 212*b* within second lock body portion 216. First body side and second body side 212*c*, 212*d* each have matching and aligned side body through slots 220*a*, 220*b* that extend angularly a predefined distance toward first lock body portion 214 and channel lock top surface 212*a* from channel lock bottom surface 212*b* such that each of side body through slots 220*a*, 220*b* are in communication with lock body through slot 218. When assembled, a portion of upper pin portion 196 is disposed into lock body through slot 218 and into a portion of push button through opening 160 while pin dowel 195 is disposed with each of side body through slots 220*a*, 220*b*. As release pin 190 moves upward toward proximal button end 158, pin dowel 195 slides along side body through slots 220*a*, 220*b* causing channel lock 210 to slide from a locking position to an unlocking position. This upward movement by release pin 190 causes channel lock 210 to slide toward and within push button slot 162 allowing push button 150 to be depressed by a user.

Ratchet gear housing 110 mates with ratchet head 130 to capture release pin 190, ball lock 170, push button 150 and channel lock 210 within housing 110 and ratchet head 130. Proximal push button end 158 and a portion of first push button portion 152 extend out of closed end opening 118 for engagement by a user to release or capture a socket onto ratchet head 130. In this embodiment, ratchet gear housing 110 has an outer circumferential surface 125 with a plurality of gear structures for interacting with a gear lock mechanism within ratchet hub 5, as is well known in the art. It is understood that other gear lock structures may be employed with socket release assembly 100 where the circumferential surface 125 may be smooth and employ other surfaces of the housing 110 to accomplish the same functionality of a ratchet known to the skilled artisan.

Figure 5:
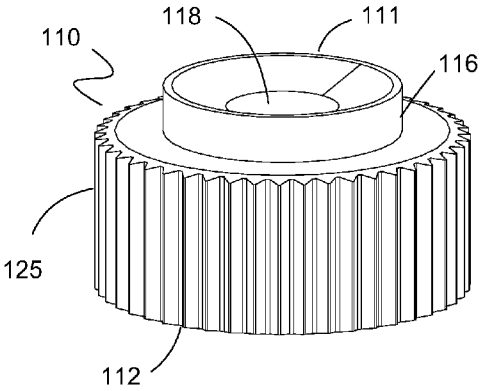
FIG. 5 is a perspective view of one embodiment of a ratchet gear housing of the socket release assembly of FIG. 2.
Figure 5A:
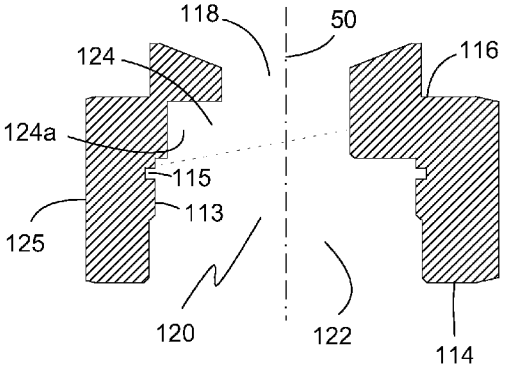
FIG. 5A is a longitudinal, cross-sectional view of the ratchet gear housing of FIG. 5.

Turning now to FIGS. 5 and 5A, there is illustrated ratchet gear housing 110 in a perspective and a cross-sectional view. Ratchet gear housing 110 has and inner wall 113 that defines first internal space 122 and second internal space 124 with closed end opening 118. As seen in FIG. 5A, second internal space 124 is not symmetrical about a center axis 50. There is additional internal space 124*a* formed within ratchet gear housing 110 in order to accommodate channel lock 210 as it slides/moves between a locking position and an unlocking position.

Figure 6:
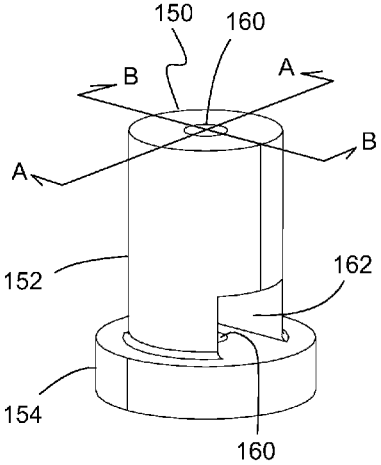
FIG. 6 is a perspective view of one embodiment of the push button of the socket release assembly of FIG. 2.
Figures 6A, 6B:
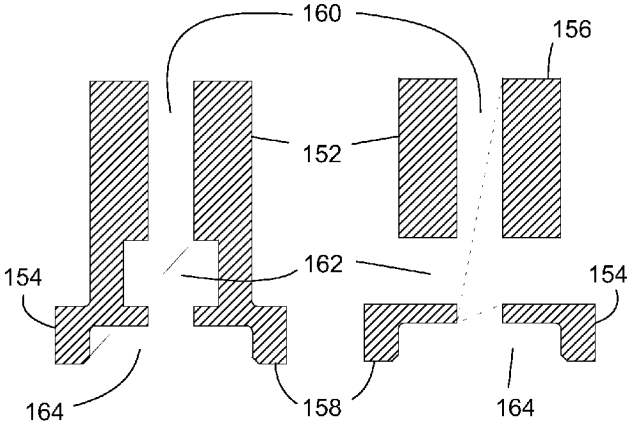
FIG. 6A is a longitudinal, cross-sectional view of the push button of FIG. 6 taken along line A-A.
FIG. 6B is a longitudinal, cross-sectional view of the push button of FIG. 6 taken along line B-B.

FIGS. 6, 6A and 6B show perspective and cross-sectional views of the embodiment of push button 150 shown in FIG. 4. In this illustrated embodiment, push button 150 is circular in shape where first push button portion 152 has a smaller diameter that second push button portion 154. It is contemplated that the cross-sectional shape of first and second push button portions 152, 154 may be square, rectangular, hexagonal, or any shape so long as the corresponding spaces in which push button 15 is disposed have similar cross-sectional shapes to facilitate use. Arrows A-A represent the cross-sectional view shown in FIG. 6A and arrows B-B represent the cross-sectional view shown in FIG. 6B. It is evident in FIGS. 6A and 6B that both longitudinal push button through opening 160 and transverse push button slot 162 extend completely through push button 150 in their respective locations. At lower head open end 156, there is formed a ball lock recess 164 that is configured to mate with push button engaging end 171 and lock body flange 175. It is push button 150 that a user pushes, which simultaneously pushes ball lock 170 against lock body biasing element 180.

FIGS. 7, 7A, 7B, and 7C illustrate various enlarged views of channel lock 210 shown in FIG. 4. It is more easily seen that side body through slot 220*a* has an open side slot end 220*a*' and a closed side slot end 220*a*". Specifically in this embodiment, open side slot 220*a* is angularly disposed relative to channel lock bottom surface 112*b* and located in first body side 112*c* such that closed slot end 220*a*" is aligned somewhat about the middle of elongated through slot 218.

FIGS. 8, 8A and 8B illustrate enlarged perspective, cross-sectional and side planar views, respectively, of ball lock 170. Ball lock body 174 has lock body flange 175 adjacent to and spaced from push button engaging end 171. Ball lock body 174 has a through opening 173 defining a stepped internal space for accommodating release pin 190 and pin biasing element 200 therein. Beginning at ball lock bottom end 172, there is a ball bearing locking notch 176 formed longitudinally into lock body outer surface 174*a* a predefined distance and having a predefined depth into ball lock body 174. Ball bearing releasing notch 177 extends longitudinally along ball lock body 174 a predefined distance and having a predefined depth into ball lock body 174 that is greater than the depth of ball bearing locking notch 176. In fact, a portion 177*a* of ball bearing releasing notch 177 in this embodiment opens into internal space 173. As seen in FIG. 8B, ball bearing releasing notch 177 is slightly narrower than ball bearing locking notch 176 to more accurately receive ball bearing 250 into ball bearing releasing notch 177. Ball lock internal space 173 includes an upper space portion 173*a*, a middle space portion 173*b* and a lower space portion 173*c*. Upper space portion 173*a* has a wider diameter in order to accommodate pin flange 194 and pin biasing element 200. Middle space portion 173*b* is sized to receive lower pin portion 198 while lower space portion 173*c* is shaped more like a funnel in order to provide a centering guidance for a pin tip element of a socket extension or a socket holder, both of which will be discuss later.

Figures 9, 9A, 9B:
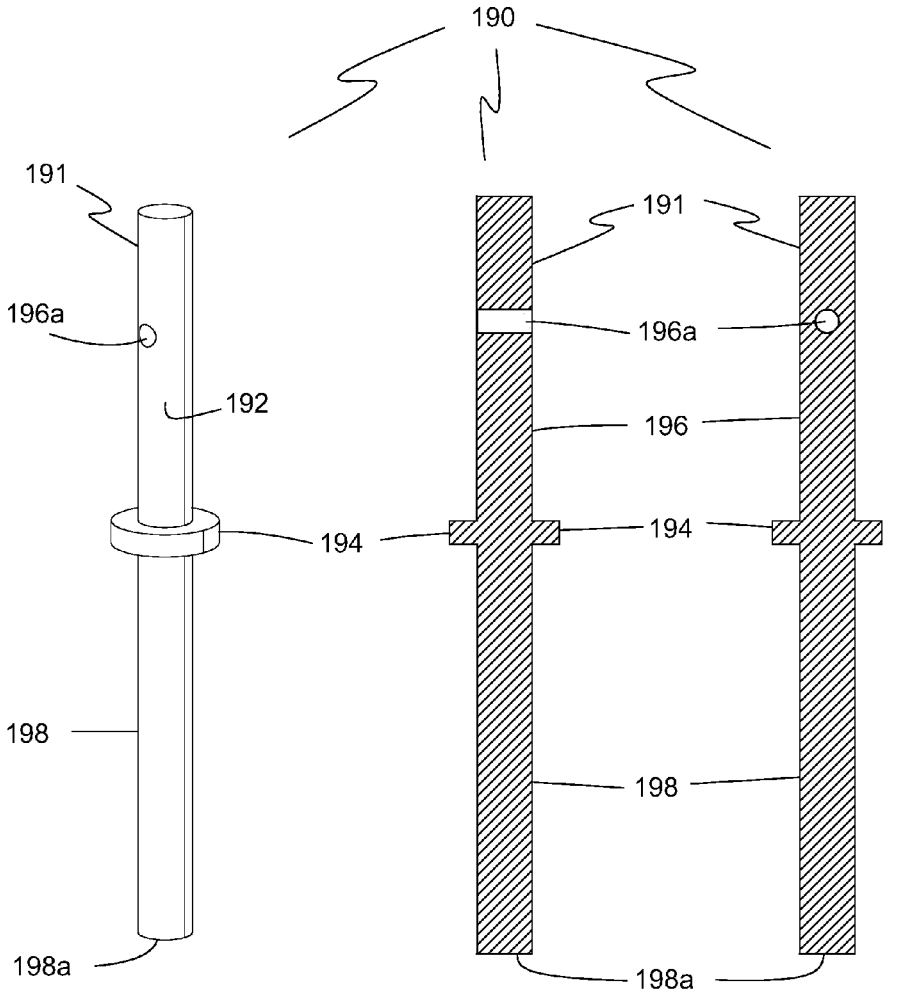
FIG. 9 is a perspective view of the release pin of FIG. 3.
FIG. 9A is a cross-sectional view of the release pin of FIG. 9 taken along line A-A.
FIG. 9B is a cross-sectional view of the release pin of FIG. 9 taken along line B-B.

Turning now to FIGS. 9, 9A and 9B, there is illustrated an enlarged view of one embodiment of release pin 190. As more clearly shown, release pin body 191 has an upper pin portion 196, a lower pin portion 198, a pin flange 194 that extends transversely from an outer circumferential surface 192. Upper pin portion 196 has a through opening 196*a* transversely disposed though release pin body 191 into which is secured pin dowel 195 (not shown). As previously described, upper pin portion 196 when assembled within socket release assembly 100 is disposed within elongated lock body through slot 218 and into push button through opening 160 while dowel pin 195, which extends from opposite sides of upper pin portion 196 in this embodiment, is disposed in each of side body slots 220*a*, 220*b*.

Figure 10:
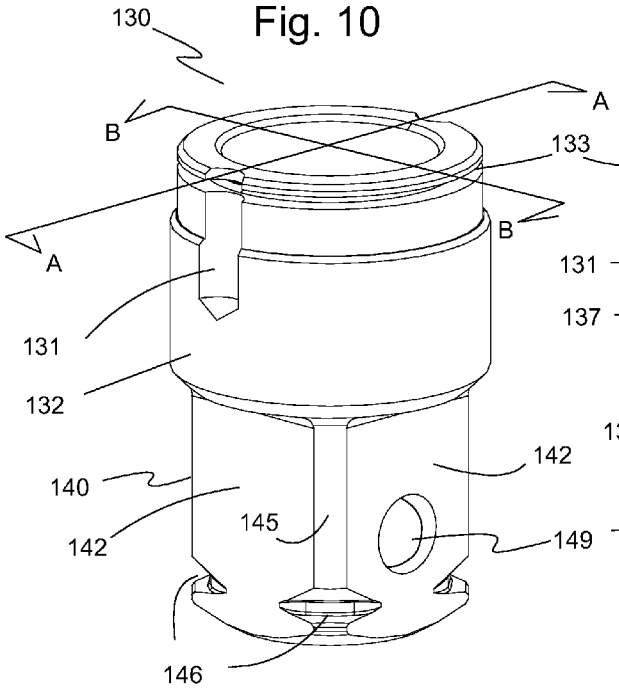
FIG. 10 is a perspective view of the ratchet head of FIG. 3.
Figure 10A:
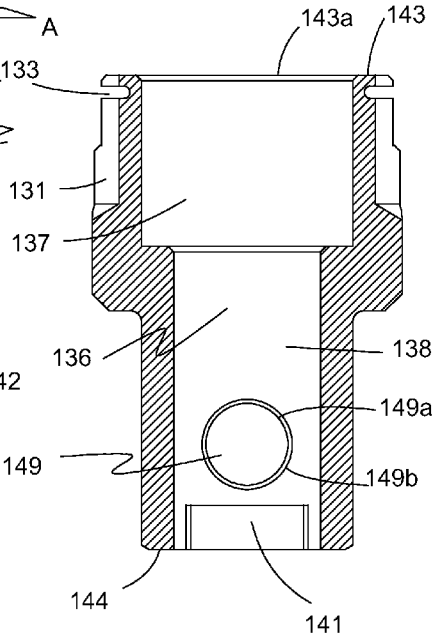
FIG. 10A is a cross-sectional view of the ratchet head of FIG. 10 taken along lines A-A.
Figure 10B:
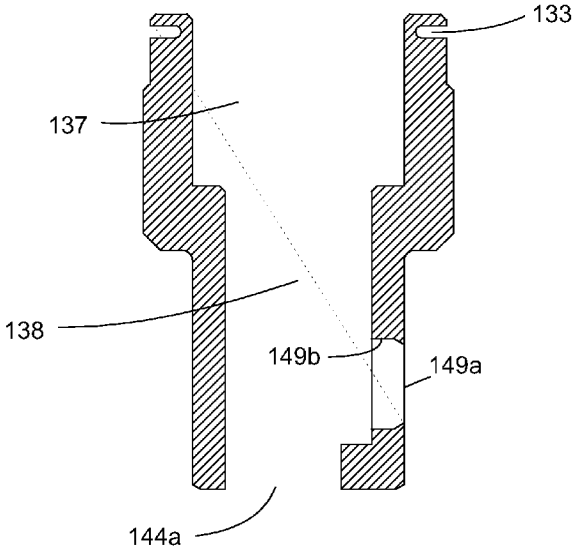
FIG. 10B is a cross-sectional view of the ratchet head of FIG. 10 taken along lines B-B.

FIGS. 10, 10A and 10B illustrate enlarged views of ratchet head 130. As shown, ratchet head 130 includes an upper head portion 132 and a lower head portion 140 that defines an internal head space 136 divided into upper head space 137 and lower head space 138. An outside surface 132*a* of upper head portion 132 has annular groove 133 adjacent to but spaced from an upper head end 143*a* and one or more upper head recesses 131 that extend from upper head end 143*a* where the one or more upper head recesses 131 extend longitudinally along upper head portion 132. As described earlier, a split ring (shown in FIG. 4) is partially disposed in annular groove 133 to lock ratchet head 130 within ratchet head housing 110 and an anti-rotation element 148 is partially disposed within upper head recess 131 to prevent ratchet head 130 from rotating within ratchet head housing 110.

Arrows A-A indicate the viewing direction for FIG. 10A and arrows B-B indicate the viewing direction for FIG. 10B. FIG. 10A is a longitudinal, cross-sectional view showing ball bearing opening 149 and a ball bearing ledge 141. Ball bearing ledge 141 cooperates with ball lock body 174 to accommodate the ball bearing locking notch 176 for proper sliding engagement of ball lock bottom end 172. Specifically, it is the area represented by first and second ball recess notches 176, 177. Ball lock bottom end 172 and ball bearing locking notch 176 are adapted to slide through lower head opening 144*a*. Ball bearing releasing notch 177, however, has a narrower width that effectively creates second ball recess lip 177*b*. Second ball recess lip 177*b* also creates a stop that prevents ball bearing releasing notch 177 from entering lower head opening 144*a*.

FIG. 10B is a longitudinal, cross-sectional view showing ball bearing opening 149 and ball bearing ledge 141. Ball bearing opening 149 has a first bearing opening 149*a* at the outer surface of side 142 and a second bearing opening 149*b* immediately adjacent to and inward from first bearing opening 149*a*. First bearing opening 149*a* has a small diameter than ball bearing 250 so that ball bearing 250 cannot pass through first bearing opening 149*a*. Second bearing opening 149*b* has a slightly larger diameter than ball bearing 250 so that ball bearing 250 is free to rotate and move inwardly toward ball bearing releasing notch 177 of ball lock 170.

Figure 11:
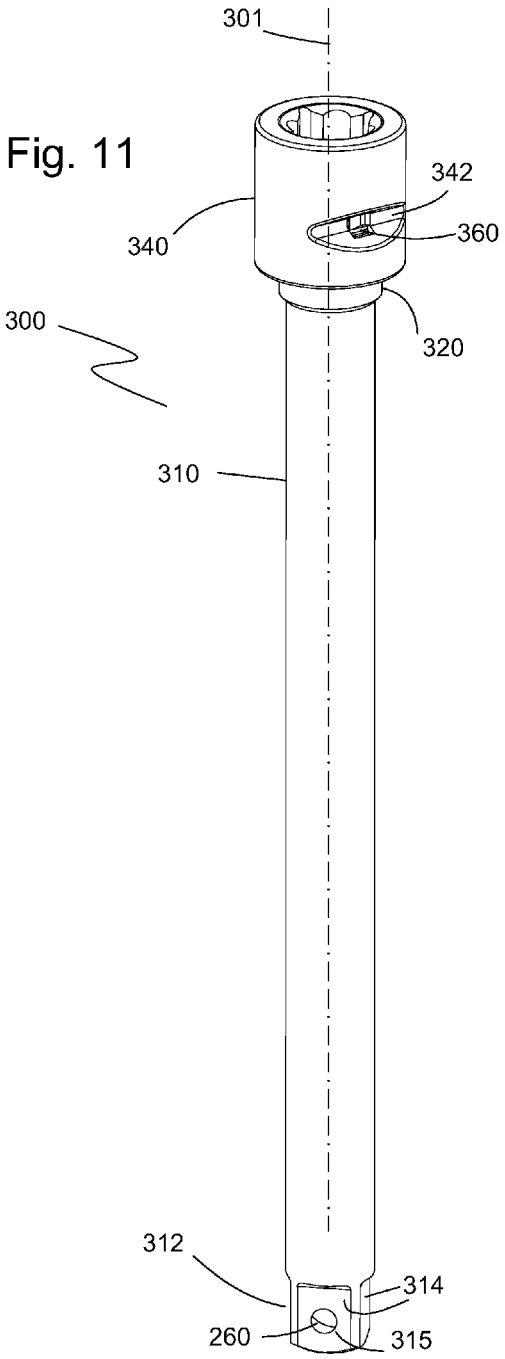
FIG. 11 is a perspective view of one embodiment of a socket extension of the present invention showing an extension receiver and an extension body.

Turning now to FIG. 11, there is illustrated one embodiment of a socket extension 300. Socket extension 300 includes an extension body 310 and an extension receiver 340. Extension body 310 has an extension socket open end 312 and an extension receiver open end 320. Extension socket open end 312, like lower head portion 140 of ratchet head 130, includes a socket portion 313 having a cross-sectional shape that is substantially square for mating with a standard socket, as is well known in the art. One of the sides 314 has an extension ball bearing opening 315 in which is disposed an extension ball bearing 260. Extension receiver 340 is fixedly coupled to extension receiver open end 320 and includes a pair of receiver notches 342 that are transverse to the central longitudinal axis 301 of the socket extension 300. In each of the receiver notches 342, there is extension lock 360 adapted for locking a ratchet head 130 therein when the socket extension 300 is attached to the ratchet 1.

Figure 12:
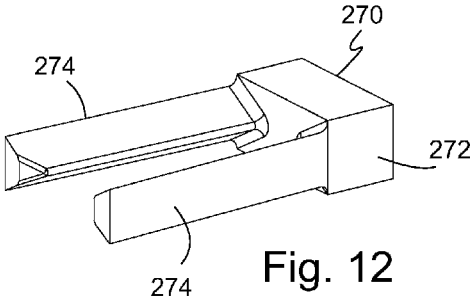
FIG. 12 is a perspective of one embodiment of an unlock device of the present invention.
Figure 13:
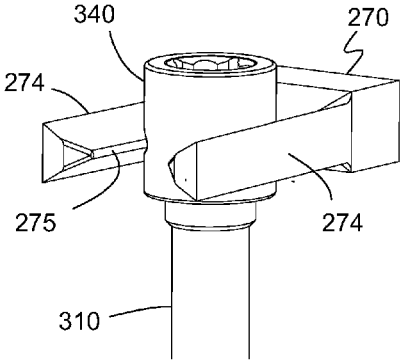
FIG. 13 is a perspective view of the unlock device attached to the extension receiver where the socket extension is in an unlocked orientation.
Figure 14:
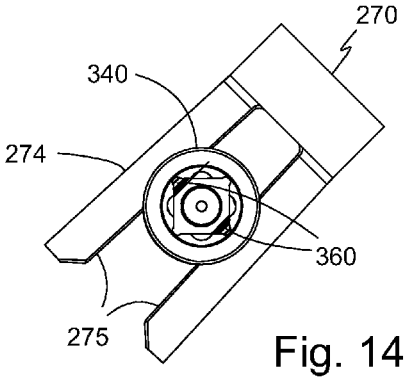
FIG. 14 is a top plan view of the unlock device and extension receiver of FIG. 13.

FIGS. 12-14 illustrate one embodiment of an extension release tool 270 adapted for use with the extension receiver 340. Extension release tool 270 has a release tool base 272 and a pair of spaced-apart release tool jaws 274 that diverge from each other as release tool jaws 274 extend away from release tool base 272. Each of the release tool jaws 274 has a triangular cross-section with a tool release edge 275. Tool release edge 275 of release tool jaws 274 are aligned opposite each other and are adapted for slidably mating with receiver notches 342. The purpose of the tool jaws 274 diverging away from each other is to facilitate coupling the extension release tool 270 with the extension receiver 340 for engaging the extension lock 360 to release the extension lock 360 from the ratchet head 130 for de-coupling the socket extension 300 and the ratchet head 130. FIGS. 13 and 14 illustrate the extension release tool 270 coupled to the extension receiver 340 from a perspective view and a top view orientation. As extension receiver 340 moves toward release tool base 272, tool release edge 275 engages extension lock 360 to release the ratchet extension 300 from ratchet head 130.

FIGS. 15 and 16 are enlarged top views of extension receiver 340 where arrows A-A in FIG. 15 indicate the cross-sectional view shown in FIG. 15A and arrows A'-A' in FIG. 16 indicate the cross-sectional view shown in FIG. 16A. Extension receiver 340 has a ratchet receiving recess 344 with a cross-sectional shape typical for standard ratchet extensions known to those of ordinary skill in the art. The difference with the present invention is the inclusion of extension receiver notches 342 and extension lock 360. FIGS. 15A and 16A are enlarged cross-sectional views of extension receiver 340 and extension receiver open end 320. Extension body 310 includes an internal extension body space 336 that extends longitudinally completely through extension body 310 from an extension receiver open end 320 to an extension socket open end 312. Internal extension body space 336 defines an upper extension space 337 and a lower extension space 338. Upper extension space 337 has a larger diameter than lower extension space 338 where upper extension space 337 is disposed completely within an upper extension portion 322 while lower extension space 338 extends from extension socket open end 312 into upper extension portion 322 and fluidly communicates with upper extension space 337. In effect, upper extension space 337 and lower extension space 338 define a stepped configuration of internal extension body space 336.

Slidably disposed within internal extension body space 336 is extension ball lock 370, extension ball lock biasing element 380 and extension ball lock adapter 330. Extension ball lock adapter 330 has an extension ball lock body engaging end 331, a ball lock bottom end 332, a ball lock adapter recess 333, and an adapter through opening 334 that extends from ball lock bottom end 332 to ball lock adapter recess 333. Extension ball lock biasing element 380 maintains extension ball lock 370 in an orientation that locks extension ball bearing 260 in a protruding orientation from a designated extension socket open end side 314 of extension socket open end 312. Extension ball lock 370 is engaged by ball lock bottom end 172, which is engaged by push button 150, to change the orientation of extension ball bearing 260 from a locked position to an unlocked position allowing extension ball bearing 260 to recede into extension socket open end 312 of extension socket body 310.

Extension release pin 390 is slidably disposed within extension ball lock 370 and extends longitudinally upwards beyond extension ball lock 370 through extension push button 350. Extension release pin 390 has an extension pin upper portion 392 with an extension pin upper end 391 that is in contact with lower release pin end 198*a* of release pin 190 when socket extension 300 is connected to ratchet head 130. Thus, extension release pin 390 does not have and does not need a release pin biasing element since socket extension has no extension channel lock that extension release pin 390 must interact with to prevent an inadvertent socket release. Instead, extension receiver 340 has extension lock 360 to prevent inadvertent release of the socket extension 300 from socket release assembly 100 and couples to the release pin 190 of the ratchet head 130 to prevent the inadvertent release of a socket from extension socket open end 312. In FIG. 16A, there is shown the locking component biasing element 361 that maintains extension lock 360 in the locked position. As seen in each of FIGS. 15A and 16A, extension lock 360 has an unlocking tool engaging portion 366.

Figure 17:
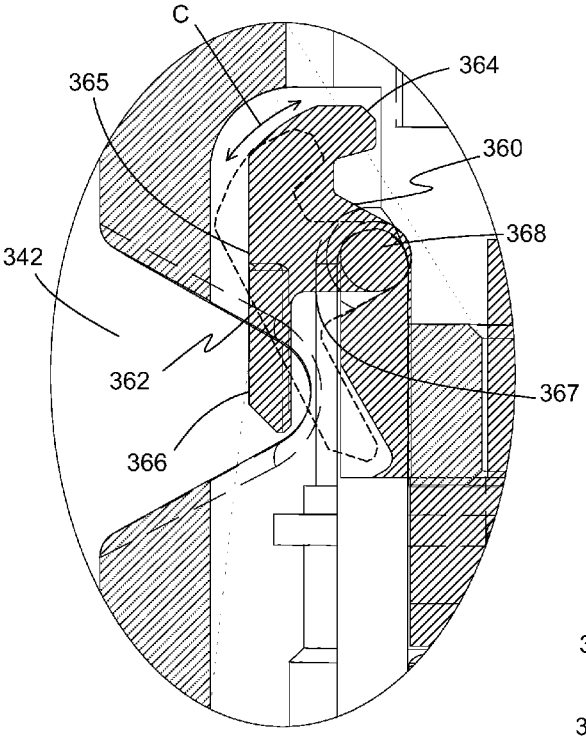
FIG. 17 is an enlarged cross-sectional view of an extension lock housed in the extension receiver of FIG. 15A and showing the extension lock in a locked orientation and an unlocked orientation.

Turning now to FIG. 17, there is illustrated an enlarged partial view of one of the extension receiver notches 342 showing the pivotable positions of the extension lock 360. Extension lock 360 has an elongated retaining hook element 362 with a retaining hook 364 on one end and the unlocking tool engaging portion 366 on an opposite end with a pivot arm 367 extending transversely from a middle portion 365 of retaining hook element 362. Middle portion 365 connects to elongated lock body 368 that extends transversely to the pivot arm 367. As seen in FIG. 17, when extension lock 360 is in a locking position, which is the normal position due to the biasing element 361, unlocking tool engaging portion 366 is disposed within receiver notch 342. Arrow C indicates the pivot motion of extension lock 360 when a tool jaw 274 engages tool engaging portion 366 causing the retaining hook element 362 to pivot and releasing/disengaging retaining hook 364 from lower head notch 146 of ratchet head 130.

Figure 18:
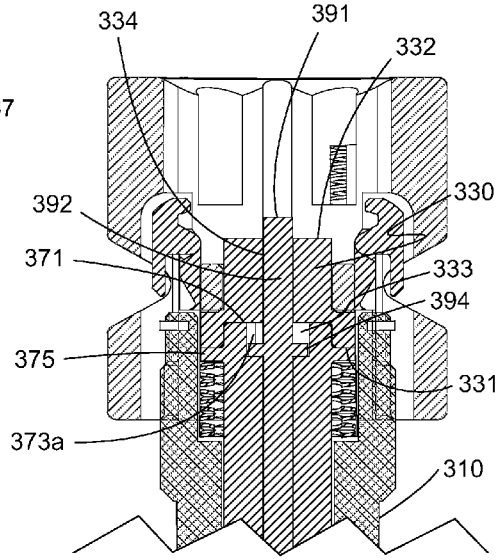
FIG. 18 is a split cross-sectional view of the socket extension of FIG. 11 showing the extension receiver, the extension body and the extension ball bearing.
Figure 18:
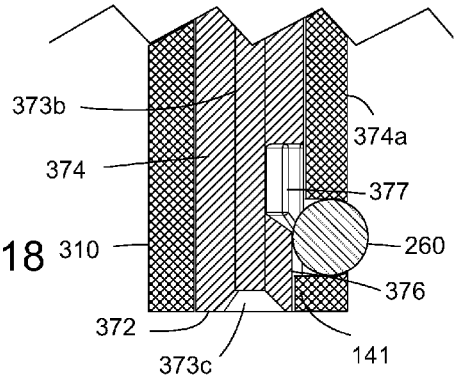

FIG. 18 is a cross-sectional, split view of socket extension 300 showing the extension receiver 340 at extension body end 320 and extension ball bearing 260 at extension socket open end 312. As can be seen, extension socket open end 312 shows the relative position of extension release pin 390 and extension ball lock 370. Extension ball lock body 310 is similarly constructed like ball lock body 170. Extension ball lock body 310 has an extension lock body flange 375 adjacent to and spaced from ball lock adapter engaging end 371. Extension ball lock body 310 has an extension through opening 373 defining a stepped internal space for accommodating extension release pin 390 therein. Beginning at extension ball lock bottom end 372, there an extension body side portion 379 that includes a extension ball bearing locking notch 376 formed longitudinally into extension lock body outer surface 374*a* a predefined distance and having a predefined depth into extension ball lock body 374. Extension ball bearing releasing notch 377 extends longitudinally along extension ball lock body 374 a predefined distance and having a predefined depth into extension ball lock body 374 that is greater than the depth of extension ball bearing locking notch 376. In fact, a portion 377*a* of extension ball bearing releasing notch 377 in this embodiment opens into internal space 373. Like ball lock 170, extension ball bearing releasing notch 377 is slightly narrower than extension ball bearing locking notch 376 to more accurately receive ball bearing 260 into extension ball bearing releasing notch 377. Extension ball lock internal space 373 includes an extension upper space portion 373*a*, an extension middle space portion 373*b* and an extension lower space portion 373*c*. Extension upper space portion 373*a* has a wider diameter in order to accommodate extension release pin flange 394. Extension middle space portion 373*b* is sized to receive extension pin lower portion 398 while extension lower space portion 373*c* is shaped more like a funnel in order to provide a centering guidance for a pin tip element of a socket holder.

FIGS. 19, 20 and 21 show perspective, side and top views of ratchet head locking component 360 and locking component holder 369. Locking component holder 356 is disposed in extension receiver 340 to support locking component axle 368 of locking component 360 as it rotates between a locking and an unlocking position. Locking component 360 also includes a locking component biasing element support 363, which extends transversely from a first axle end 368*a* in a direction opposite locking component pivot arm 367. As can be seen in the Figures, biasing element support 363 interacts with locking component biasing element 361 such that as engaging portion 366 is acted upon by unlocking tool 270 biasing element support 363 compresses biasing element 361, which causes locking component 360 to return to its locking position when unlocking tool 270 is removed.

Turning now to FIGS. 22, 23 and 24, there is illustrated one embodiment of a socket holder 400 of the present invention. Socket holder 400 includes a holder body 410 with a holder recess 412 and a recess opening 413. Holder recess 412 includes a first recess portion 414, a second recess portion 416 and interconnecting recess portions 418. First recess portion 414 is sized to receive a predefined tool socket 6. Centrally disposed within holder recess 412 is a socket holder peg 420 having a holder peg body 422. Holder peg body 422 includes an upper peg body portion 424, a lower peg body portion 426 and a peg body flange 428 annular disposed around peg body 422 that defines the separation between upper and lower peg body portions 424, 426. Peg body flange 428 is disposed within second recess portion 416 with a peg biasing element 430. Upper peg portion 424 is positioned within first recess portion 414 and extends through first interconnecting recess portion 418*a*. Lower peg portion 426 is position within second recess portion 416 and extends through second interconnecting recess portion 418*b*. Peg biasing element 430 allows socket holder peg 420 to slide vertically a predefined distance when socket holder peg 420 is engaged by ratchet head 130 or socket extension 300. A release pin engaging element 425 extends from an upper peg portion end 424*a*. Release pin engaging element 425 is sized to mate and engage with either of release pin 190 of ratchet head 130 or extension release pin 390 of socket extension 300. In this embodiment, release pin engaging element 425 is centrally located at upper portion end 424*a*. Upper peg portion end 424*a* is also sized to interact and engage with either of ball lock 170 or extension ball lock 370, as the case may be.

The present invention is designed as a drop prevention system to prevent inadvertent or accidental release of an attached socket or a socket extension, which is very important in high working environments where such a release could either damage expensive equipment or injure a person or both, below the work location.

Figure 25:
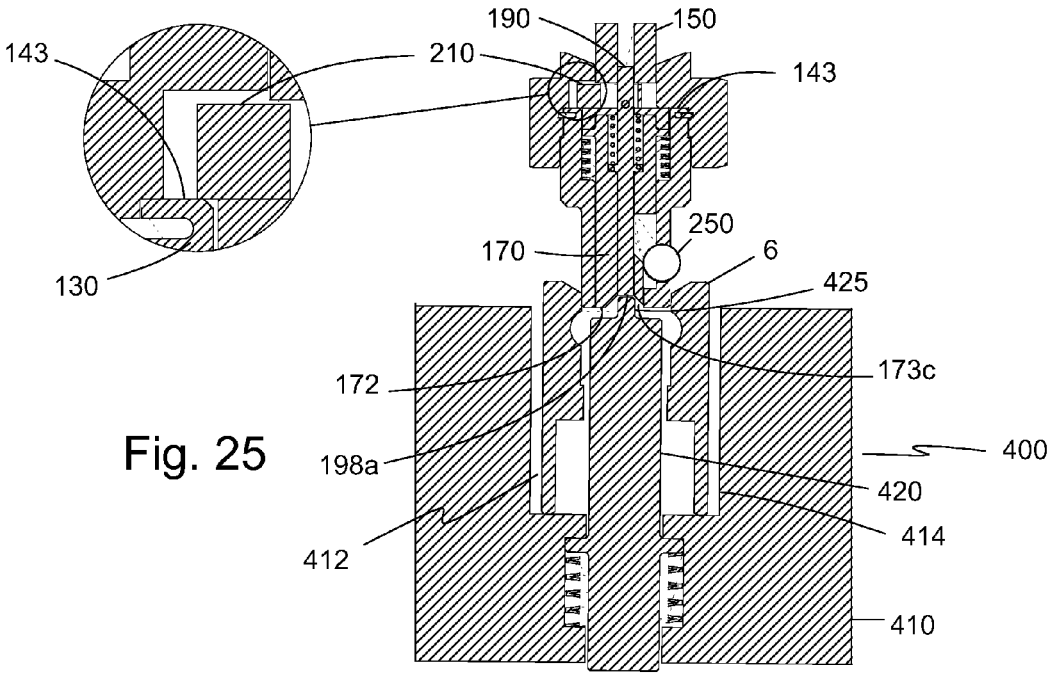
FIG. 25 is a cross-sectional view of the socket release assembly in position over the socket holder for attaching a socket to the ratchet head.

Turning now to FIGS. 25-30, there is illustrated the position of each component as a socket is attached to the socket release assembly 100 of the present invention. FIG. 25 is a cross-sectional view of the socket release assembly 100, the socket holder 400 and a socket 6 without ratchet 1 for clarity as socket 6 is about to be attached to socket release assembly 100. As can be seen, channel lock 210 is in a button locked position so that push button 150 cannot not be depressed. In the enlarge view, channel lock 210 overhang over ratchet head upper head portion 132 and effectively blocks the push button 150 from being able to depress ball lock 170. Ball lock bottom end 172 of ball lock 170 is aligned with ratchet bottom end 112 and release pin lower end 198*a* is aligned with the innermost recessed portion of ball lock lower space portion 173*c*. Socket holder 400 has socket 6 disposed within socket holder recess 412 with release pin engaging element 425 of socket holder peg 420 disposed at a position such that release pin lower end 198*a* of ratchet head 130 can contact release pin 190 before ball bearing 250 contacts socket 6. Socket 6 is typically retained within socket holder 400 by friction means sufficient to retain socket 6 in socket holder 400 but sufficiently releasable so that when socket 6 is attached to ratchet head 130, it can be easily removed from socket holder 400. At this point, ratchet release assembly 100 is in a ready position for receiving socket 6. Next, ratchet release assembly 100 is pushed into socket 6.

Figure 26:
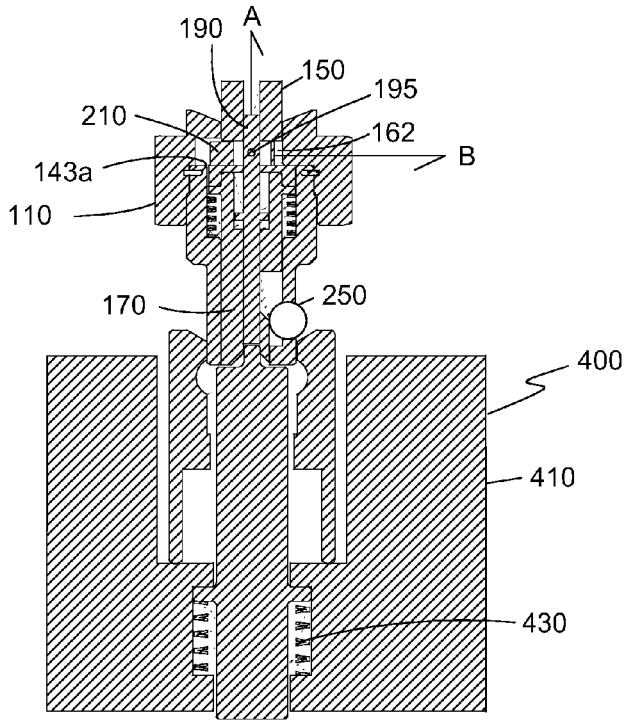
FIG. 26 is a cross-sectional view of the socket release assembly and socket holder with socket of FIG. 25 showing the socket holder peg engaging the release pin of the socket release assembly.

FIG. 26 shows a cross-sectional view of ratchet release assembly 100 pushed into socket 6. At this point, pin engaging element 425 forces release pin 190 to recess into ball lock 170 since peg biasing element 430 provides a greater resistance than pin biasing element 200 so that release pin 190 slides further into ball lock 170. This action causes pin dowel 195 to slide along channel lock side body through slots 220*a*, 220*b*, which in turn causes channel lock 210 to slide into transverse push button slot 162 so that channel lock end 212*e* of first lock body portion 214 moves over upper head opening 143*a* allowing push button 150 to push ball lock 170.

Figure 27:
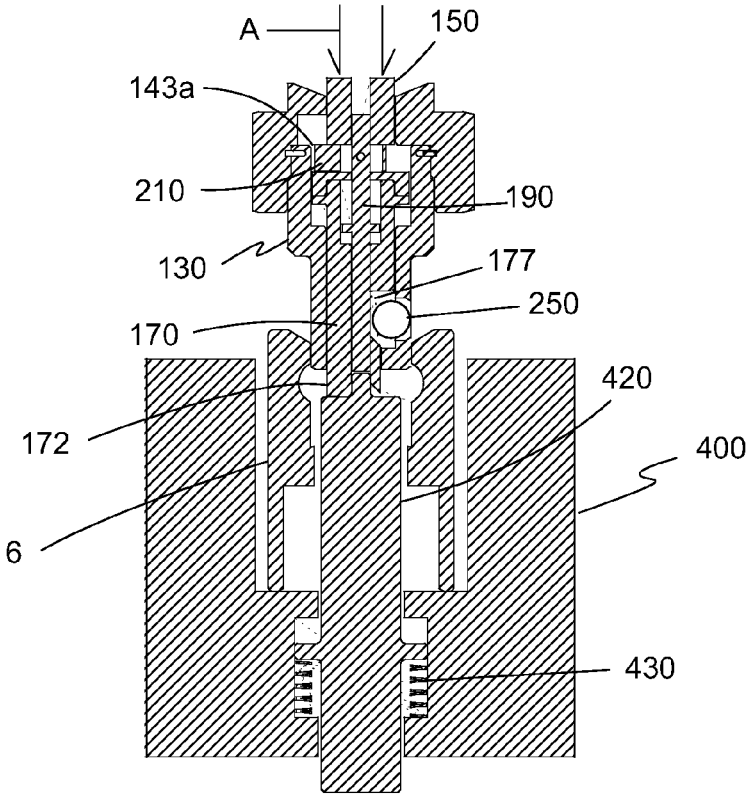
FIG. 27 is a cross-sectional view of the socket release assembly and socket holder with socket of FIG. 26 showing the push button depressed and pushing the ball lock into a ball bearing release orientation.

FIG. 27 shows a cross-sectional view of ratchet release assembly 100 with push button 150 depressed (as indicated by arrows A) causing ball lock 170, release pin 190 and channel lock 210 to slide within ratchet head 130 such that ball lock bottom end 172 pushes socket holder peg 420 further into socket holder 400 against peg biasing element 430. As can be seen in the figure, ball lock 170 moves ball bearing releasing notch 177 to align with ball bearing 250 allowing ball bearing 250 to be pushed into lower head portion 140 of ratchet head 130 by socket 6. Because ball bearing 250 is now recessed into lower head portion 140, socket head assembly 100 can be further pushed against socket holder peg 420 overcoming the biasing resistance of peg biasing element 430 causing socket holder peg 420 to be pushed further into socket holder 400.

Figure 28:
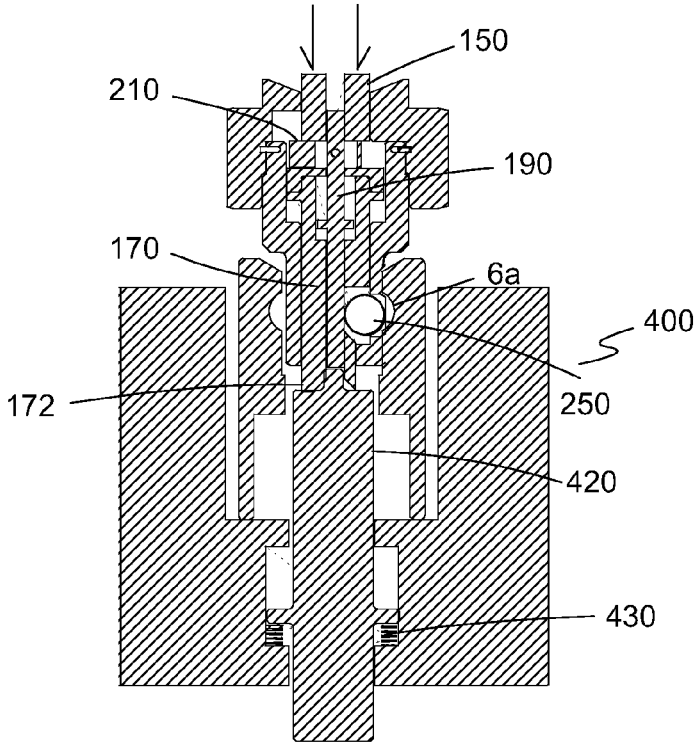
FIG. 28 is a cross-sectional view of the socket release assembly and socket holder with socket of FIG. 27 showing the ratchet head of the socket release assembly inserted into the socket.
Figure 29:
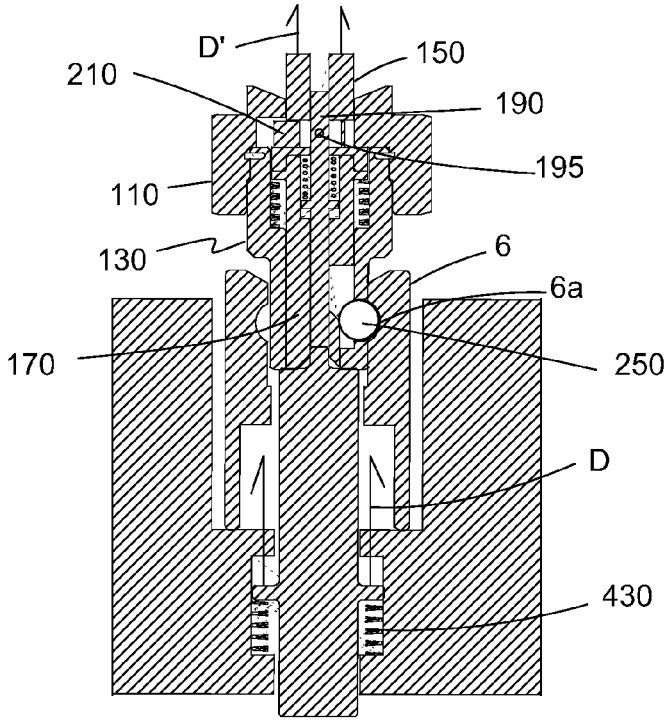
FIG. 29 is a cross-sectional view of the socket release assembly and the socket holder with socket of FIG. 28 showing the push button and the ball lock in an undepressed orientation with the ball bearing in a locked orientation within the ball bearing recess in the socket.

FIG. 28 illustrates a cross-sectional view of ratchet release assembly 100 depressing socket holder peg 420 further into socket holder 400 so that ball bearing opening 149 in lower head portion 140 of ratchet head 130 aligns with a socket ball recess 6*a*.

Next, push button 150 is released as indicated by arrows D'. This action results in the illustration shown in FIG. 29. When push button 150 is released, the peg biasing element 430 has sufficient force as shown by reference arrows D to push/slide ball lock 170, release pin 190 and push button 150 back into ratchet head 130 to the point where ball lock bottom end 172 becomes flush with lower head open end 144. This action causes ball bearing locking notch 176 to engage ball bearing 250 forcing ball bearing 250 to seat against outer ball bearing opening 149*a* of ball bearing opening 149 effectively locking ball bearing 250 into its locking position within socket ball recess 6*a* of socket 6.

Figure 30:
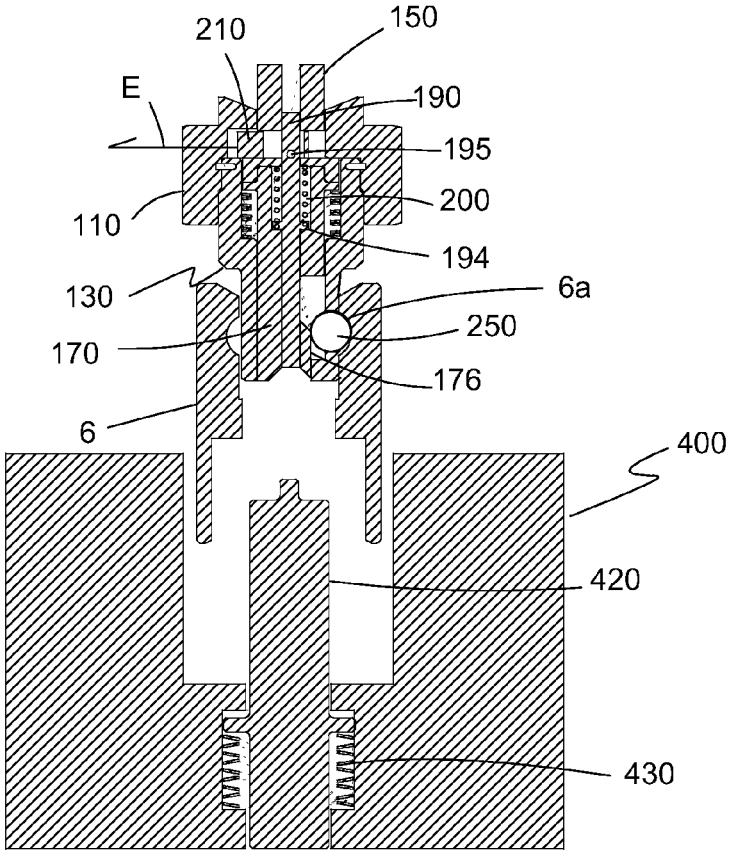
FIG. 30 is a cross-sectional view of the socket release assembly and the socket holder of FIG. 29 showing the socket attached to the ratchet head and the socket being removed from the socket holder.

FIG. 30 shows socket 6 attached to lower head portion 140 of ratchet head 130 as socket release assembly 100 and socket 6 is being removed from socket holder 400. As can be seen, socket holder peg 420 returns to its initial position by the force of peg biasing element 430. The pin biasing element 200 forces release pin flange 194 to the bottom of ball lock upper space portion 173*a*. As release pin 190 is moved, pin dowel 195 within side body slots 220*a*, 220*b* of channel lock 210 causes channel lock 210 to slide a predefined distance out of transverse push button slot 162 to a locking position so that push button 150 cannot be depressed accidentally or inadvertently.

It is the interaction of the various components of socket release assembly 100 and especially channel lock 210 that prevents an accidental or inadvertent release of socket 6 from ratchet head 130. Without release pin 190 being engaged to move the channel lock 210, push button 150 cannot be accidentally or inadvertently depressed. Because push button 150 cannot be accidentally or inadvertently depressed without release pin engaging element 425 of socket holder peg 420 engaging release pin 190, body lock 170 cannot be slidably moved so that ball bearing 250 aligns with ball bearing releasing notch 177, which position is required to allow ball bearing 250 to be pushed into lower head portion 140. Because ball bearing 250 cannot be pushed into lower head portion 140, socket 6 cannot be accidentally or inadvertently removed or fall away from ratchet head 130 under normal use conditions.

Socket extension 300 is also similarly configured so that when it is attached to lower head portion 140, socket 6 cannot be inadvertently or accidentally released without release pin engaging element 425 of socket holder peg 420 engaging extension release pin 390, which engages release pin 190 causing the action described above to occur. Socket extension 300 also cannot be accidentally or inadvertently released from lower head portion 140 due to ratchet head locking component 360 where ratchet head locking component can only be engaged to release socket extension 300 using extension release tool 270.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A socket release assembly for a ratchet drive or ratchet wrench, the assembly comprising:

a ratchet gear housing having a gear housing open end, a gear housing closed end having a closed end opening, and a housing internal space between the gear housing open end and the gear housing closed end, the closed end opening in fluid communication with the housing internal space;

a ratchet head having an upper head portion, an upper head open end, a lower head portion having a substantially square-shaped cross-section, a lower head open end, and an internal head space extending between the upper head open end and the lower head open end, the upper head portion disposed in the gear housing open end and fixedly attached within the housing internal space, the lower head portion having a ball bearing opening adjacent to and spaced from the lower head open end and extending through a side of the lower head portion, the ball bearing opening in fluid communication with the internal head space;

a push button having a first push button portion with a first button end, a second push button portion with a second button end, an internal channel extending longitudinally between the first button end and the second button end, and a button slot extending transversely through the first push button portion adjacent the second push button portion;

a channel lock having a channel lock body, a channel lock top surface, a channel lock bottom surface, a first channel lock side, a second channel lock side, a channel lock slot extending between the first channel lock side and the second channel lock side, the channel lock slot extending angularly from the channel lock bottom surface a predefined distance towards the channel lock top surface, and an elongated lock body through slot extending between the channel lock top surface, the channel lock bottom surface, the first channel lock side, the second channel lock side, and containing the lock body through slot, the channel lock slidably disposed within the button slot between a push button locking position and a push button unlocking position;

a ball lock having a ball lock body with a push button engaging end, a ball lock bottom end, a lock body flange extending transversely from a ball lock outer surface of the ball lock body adjacent to and spaced from the push button engaging end, a body side portion that extends longitudinally from the ball lock bottom end a predefined distance along the ball lock body defining a ball bearing locking notch and a ball bearing releasing notch, and a ball lock internal space having a lower space portion and an upper space portion, the ball lock being slidably disposed within the internal head space;

a ball bearing disposed within the internal head space between the body side portion and the lower head portion with the ball bearing opening; and a release pin having an upper pin portion, a lower pin portion, and a release pin flange extending transversely between the upper pin portion and the lower pin portion, the release pin slidably disposed within the ball lock internal space and extending from the ball lock bottom end through the channel lock body and into the first button portion of the push button, the release pin having a pin dowel extending transversely from the upper pin portion and disposed within the channel slot of the channel lock to cause the channel lock to slide within the button slot between the push button locking position and the push button unlocking position when the release pin is slidably moved within the ball lock.

2. The assembly of claim 1 wherein the ratchet head has at least lower head notch formed at a corner of the lower head portion adjacent to and spaced from the lower head open end.

3. The assembly of claim 2 further comprising:

a socket extension comprising:

an extension receiver having an upper ratchet head opening, a lower receiver opening, a ratchet head recess, and an extension lock disposed within the extension receiver, the extension lock having an elongated lock body and a retaining hook element extending transversely from the elongated lock body, the retaining hook element having a retaining hook, the extension lock positioned to pivotally position the retaining hook into and out of the ratchet receiver recess wherein the retaining hook is configured to engage with the at least one lower head notch of the lower head portion when the ratchet head is disposed within the extension receiver;

an extension body having an extension receiver portion with an extension receiver open end, an extension body middle portion, an extension socket portion with an extension socket open end, an extension internal body space extending between the extension receiver open end and the extension socket open end, the extension receiver portion fixedly secured to the lower receive opening of the extension receiver, the extension socket portion having a ball bearing opening adjacent to and spaced from the extension socket open end and extending through a side of the extension socket portion, the extension ball bearing opening in fluid communication with the extension internal body space;

an extension ball lock having an extension ball lock body with a ball lock adapter engaging end, an extension ball lock bottom end, an extension lock body flange extending transversely from an extension outer body surface of the extension ball lock body adjacent to and spaced from the release pin engaging end, an extension body side portion that extends longitudinally from the extension ball lock bottom end a predefined distance along the extension ball lock body defining an extension ball bearing locking notch and an extension ball bearing releasing notch, and an extension ball lock internal space having a lower space portion and an upper space portion, the extension ball lock being slidably disposed within the extension body and the extension receiver;

an extension ball lock adapter having an extension ball lock body engaging end, a ball lock bottom engaging end, a ball lock adapter recess formed at the ball lock bottom engaging end, and an adapter through opening that extends from the extension ball lock body engaging end to the ball lock adapter recess;

a socket retaining ball bearing disposed within the extension ball lock internal space between the extension body side portion and the extension socket portion through the ball bearing opening; and an extension release pin having an extension pin upper portion, a extension pin lower portion, and an extension release pin flange extending transversely between the extension pin upper portion and the extension pin lower portion, the extension release pin slidably disposed within the extension ball lock internal space and extending from the extension lower space portion and out through the extension ball lock adapter a predefined distance.

4. The assembly of claim 3 further comprising an extension ball lock release biasing element disposed on the extension ball lock that biases the extension ball lock into an orientation to maintain the extension ball bearing within the extension ball bearing locking recess.

5. The assembly of claim 3 wherein the extension ball lock bottom end has a frusto-conical recess and wherein an extension pin lower end of the extension pin lower portion is disposed in the frusto-conical recess and spaced from the extension ball lock bottom end.

6. The assembly of claim 3 wherein the release pin engaging end of the extension ball lock body is in constant mating contact with the ball lock bottom end of the ball lock body when the socket extension is connected to the ratchet head of the socket release assembly.

7. The assembly of claim 1 further comprising a release pin biasing element disposed on the release pin that biases the release pin into a button locking position.

8. The assembly of claim 1 further comprising a ball lock biasing element disposed on the ball lock that biases the ball lock into an orientation to maintain the ball bearing within the ball bearing locking recess.

9. The assembly of claim 1 wherein the ball lock bottom end has a frusto-conical recess and wherein a release pin lower end of the lower pin portion is disposed in the frusto-conical recess and spaced from the ball lock bottom end.

10. The assembly of claim 1 wherein the push button engaging end of the ball lock is in constant mating contact with the second button end of the push button.

11. The assembly of claim 1 further comprising a socket holder having a holder recess with first recess portion and a recess opening for holding a socket, and a socket holder peg disposed centrally within the holder recess and extending vertically toward the recess opening wherein the socket holder peg has a release pin engaging element adapted for alignment with the release pin of the socket release assembly whereby the release pin engaging element engages the release pin to cause the release pin to slidably move within the ball lock body when attaching the ratchet head to a socket wherein the pin dowel disposed within the channel slot of the channel lock causes the channel lock to slide within the button slot to the push button unlocking position.

12. A method of preventing the inadvertent release of a socket from a ratchet, the method comprising:

engaging a release pin slidably and centrally disposed within a ball lock of a ratchet head by a release pin engaging element disposed in a socket holder;

pushing the ratchet head toward the socket holder wherein the release pin engaging element causes the release pin to remain stationary while the ratchet head moves into a socket disposed and held by the socket holder causing a channel lock to slide transversely relative to the release pin to a push button unlocking position;

pushing a push button to slide a ball lock to a ball bearing unlocked position so that the ratchet head enters the socket to a point where a ball bearing in the ratchet head aligns with a ball bearing recess in a wall of the socket; and releasing the push button to thereby slide the ball lock to a ball bearing locked position and lock the ball bearing in the ball bearing recess capturing the socket onto the ratchet head while the release pin simultaneously causes the channel lock to return to a push button locking position preventing unintended release of the socket from the ratchet head.

* * * * *